US009296525B2

(12) United States Patent
Murphy et al.

(10) Patent No.: US 9,296,525 B2
(45) Date of Patent: Mar. 29, 2016

(54) ENHANCED DISPENSING AND DOSAGING TECHNIQUES FOR FLUID CONTAINERS

(71) Applicant: RLM Group Ltd., Mt. Kisco, NY (US)

(72) Inventors: Robert L. Murphy, Somers, NY (US); Charles A. Curtiss, Norwalk, CT (US)

(73) Assignee: RLM Group Ltd., Mt. Kisco, NY (US)

( * ) Notice: Subject to any disclaimer, the term of this patent is extended or adjusted under 35 U.S.C. 154(b) by 63 days.

(21) Appl. No.: 13/692,502

(22) Filed: Dec. 3, 2012

(65) Prior Publication Data

US 2014/0151401 A1 Jun. 5, 2014

(51) Int. Cl.
*B65D 35/54* (2006.01)
*B65D 35/44* (2006.01)

(52) U.S. Cl.
CPC ..... *B65D 35/44* (2013.01)

(58) Field of Classification Search
CPC ..... B65D 35/28; B65D 35/54; B65D 35/00; B65D 5/22; B65D 47/00; B67D 3/00
USPC ..... 222/92–107, 190, 189.02–189.11, 222/562–563, 146.6, 511, 478–489, 222/490–497, 554, 513–515, 212–213
See application file for complete search history.

(56) References Cited

U.S. PATENT DOCUMENTS

| | | | | |
|---|---|---|---|---|
| 2,129,055 A | | 9/1938 | Gibbs | |
| 2,853,728 A | | 9/1958 | Nadai | |
| 2,957,501 A | | 10/1960 | Holmes | |
| 3,102,651 A | | 9/1963 | Boese | |
| 3,249,268 A | | 5/1966 | Neuner | |
| 3,807,608 A | | 4/1974 | Nilsson | |
| 4,381,846 A | | 5/1983 | Heck | |
| 4,597,511 A | | 7/1986 | Licari | |
| 4,635,826 A | * | 1/1987 | Hatakeyama et al. | 222/147 |
| 4,964,548 A | | 10/1990 | Kenyon, Jr. | |
| D312,405 S | | 11/1990 | Kenyon, Jr. | |

(Continued)

FOREIGN PATENT DOCUMENTS

| | | |
|---|---|---|
| CA | 2097283 | 2/2005 |
| CN | 20160487 4 U | 10/2010 |
| WO | WO 2004/069679 A1 | 8/2004 |

OTHER PUBLICATIONS

U.S. Appl. No. 13/692,423, filed Dec. 3, 2012.

(Continued)

*Primary Examiner* — Paul R Durand
*Assistant Examiner* — Andrew P Bainbridge
(74) *Attorney, Agent, or Firm* — Michael D. Lazzara, Esq.; Pietragallo Gordon Alfano Bosick & Raspanti, LLP

(57) ABSTRACT

In various embodiments, the invention provides enhanced structures, devices, and techniques that allow fluids and liquid products, such as cosmetics, to dispense in a more even, smoother, and more predictable manner from fluid containers. In one embodiment, a plug is positioned within at least a portion of an interior of a nozzle of a fluid container. The plug may include a base portion having at least one fluid flow opening formed therein and a bellows portion. In operation, the bellows portion may expand to an elongated state upon application of a threshold fluid pressure to create a pathway for communicating fluid, and may contract to a compressed state which creates a fluid communication seal between a fluid repository and dispensing orifice of the fluid container.

11 Claims, 35 Drawing Sheets

(56) References Cited

U.S. PATENT DOCUMENTS

| | | | | |
|---|---|---|---|---|
| 5,213,236 | A | 5/1993 | Brown et al. | |
| 5,839,626 | A | 11/1998 | Gross et al. | |
| 6,053,184 | A | 4/2000 | DeVone | |
| 6,145,707 | A | 11/2000 | Baudin | |
| 6,199,725 | B1 | 3/2001 | Garibaldi | |
| 6,315,483 | B1 | 11/2001 | Velliquette | |
| 6,394,315 | B1 | 5/2002 | Banks | |
| 6,581,808 | B2 | 6/2003 | De Laforcade | |
| 6,854,623 | B2 * | 2/2005 | Masuda | 222/212 |
| 7,478,736 | B2 | 1/2009 | Morgan | |
| 7,594,595 | B2 | 9/2009 | Gueret | |
| 7,823,756 | B2 * | 11/2010 | Alley | 222/528 |
| 7,971,755 | B2 | 7/2011 | Faurie | |
| 8,052,016 | B2 | 11/2011 | Wang | |
| 8,056,766 | B2 | 11/2011 | Grevin | |
| 8,360,287 | B2 | 1/2013 | Ciavarella et al. | |
| 8,408,433 | B2 * | 4/2013 | Fontana | 222/547 |
| 8,485,398 | B2 * | 7/2013 | Kneer | 222/494 |
| 8,517,222 | B2 * | 8/2013 | Painchaud et al. | 222/212 |
| 2007/0295764 | A1 | 12/2007 | Socier | |
| 2008/0317540 | A1 | 12/2008 | Wang | |
| 2009/0302073 | A1 | 12/2009 | McKeown | |

OTHER PUBLICATIONS

U.S. Appl. No. 13/692,439, filed Dec. 3, 2012.
U.S. Appl. No. 13/692,452, filed Dec. 3, 2012.
U.S. Appl. No. 13/692,466, filed Dec. 3, 2012.
U.S. Appl. No. 13/692,474, filed Dec. 3, 2012.
U.S. Appl. No. 13/692,480, filed Dec. 3, 2012.
International Search Report for International Application PCT/US2013/072762, dated Apr. 28, 2014, 3 pages.
Written Opinion of the International Searching Authority for International Application PCT/US2013/072762, dated Apr. 28, 2014, 6 pages.

* cited by examiner

ENHANCED DISPENSING AND DOSAGING TECHNIQUES FOR FLUID CONTAINERS

FIELD OF THE INVENTION

In various embodiments, the present invention generally relates to tools, techniques, structures, devices, and processes for effectively and efficiently dispensing fluid from fluid containers. In particular embodiments of the invention, improved fluid containers and associated structures are provided for dispensing cosmetic products.

BACKGROUND

In the world of high quality consumer products, it is important to have product designs and packages that function effectively for their intended purposes. With respect to the cosmetics industry, for example, it is especially important to provide fluid containers that can meet consumer needs by efficiently and cleanly dispensing fluids such as creams, oils, make-up, and other types of cosmetics.

However, many current package and container designs for fluid containers suffer from deficiencies in how they deliver an appropriate dosage of fluid and how they maintain a clear and open path for fluid to flow. An insufficient dosage of fluid does not provide enough product to meet the needs of the consumer. On the other hand, an excess dosage generates extra product that cannot be readily used by the consumer. This extra product creates a clean-up problem for the consumer who must decide how to dispose of the extra fluid that has been dispensed. Also, such extra product can cause undesirable clogging of the dispensing orifice of a fluid container. In certain situations, fluid product within a container dries, cracks, and leaves residue in what may have been promoted or marketed as a "premium" package that commanded a commensurately "premium" price but which has now caused consumer dissatisfaction.

In view of the issues afflicting existing product designs and packages, including within the cosmetics industry, enhanced product dispensing and dosaging technology is needed. Fluid dispensing structures, devices, and techniques are needed that can dispense fluid in an even, smooth and predictable manner, without causing significant dripping or substantial clogging of the dispensing orifice of a fluid container.

BRIEF DESCRIPTION OF THE FIGURES

The utility of the embodiments of the invention will be readily appreciated and understood from consideration of the following description of the embodiments of the invention when viewed in connection with the accompanying drawings, wherein.

DESCRIPTION

Figure 1:
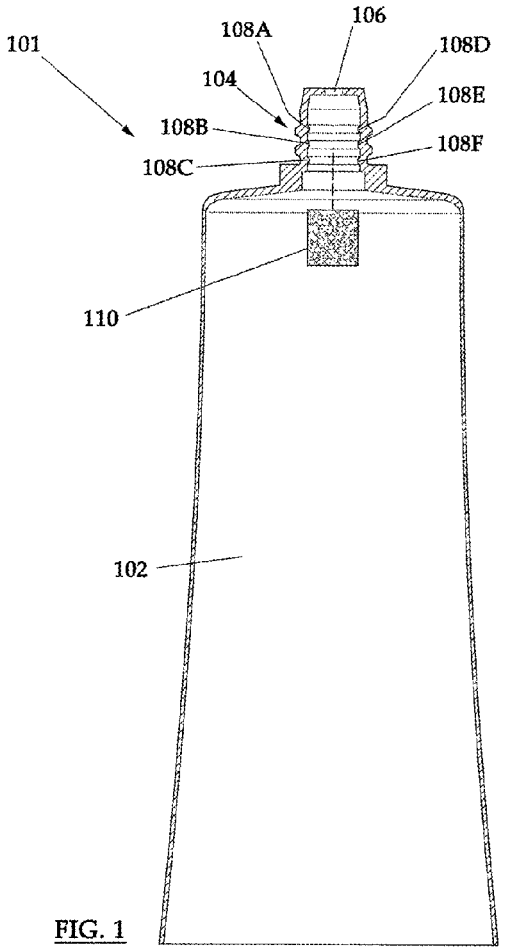
FIGS. 1 through 4 illustrate various aspects of an example of an apparatus structured for dispensing fluid in accordance with various embodiments of the invention.

In developing the various embodiments of the invention described herein, the inventors have created structures, devices, and techniques that allow fluid and liquid products, such as cosmetics, to dispense in a more even, smoother, and more predictable manner. The inventors appreciate that reasonable consumer expectations of predictable fluid dispensing should include substantially no dripping or oozing from the dispensing orifice after a suitable amount of product has been dispensed. Also, in connection with employing different embodiments of the invention, a consumer should be able to hold a tube or other type of fluid container in an inverted position without causing substantial dripping or oozing from its dispensing orifice. The inventors have recognized the need for an accurate correlation, and in certain cases independence, between a threshold pressure applied to a fluid container (such as manual pressure applied by a user, or pressure applied by some other device) and an appropriate amount of fluid dispensed from the container. It has been appreciated that minimizing accumulation of fluid at the dispensing site of the fluid container avoids clogging the dispensing orifice and the attendant clean-up that typically must be performed by a consumer.

In developing the invention described herein, the inventors have satisfied a long-felt and long overlooked need in the cosmetics industry, among other areas, to enhance inefficient and less than optimum fluid dispensing and dosaging technology in existing cosmetic containers. Use of certain embodiments of the invention can resist unintended overdosing of fluid, can resist dripping or oozing from a container orifice after initial dispensing onto a consumer's finger or pad, and can resist dripping or oozing from the orifice even if the fluid container is shaken or agitated. In certain aspects of the invention, a tube-type fluid container can be held in an inverted position without substantial dripping or oozing, even after the container has been shaken by a consumer, for example, to collect product near the dispensing end of the container. Also, in the absence of a threshold fluid pressure, the container may be structured to not permit a bead of product to form at the orifice, even if the container is in an inverted position, for example.

Embodiments of the invention can also provide devices that allow consumer finger pressure, for example, on a fluid container body to dispense product as a substantially constant linear bead. The device may be structured so that product is dispensed from the orifice in a clean (i.e., non-splattering), substantially regular, and substantially unvarying stream. The device may also be structured to resist intermittent or sudden, unexpected flow from orifice, and to resist unwanted pooling of fluid product on the finger or pad of a consumer, for example.

It can be appreciated that consumer product companies are often concerned with excessive dispensing because of liability claims arising from damage to clothing, furniture, or other articles as a result of excess product. Consumer product companies are also sensitive to reducing the costs of packaging and dispensing technology while maximizing marketing appeal to consumers. In developing the various embodiments of the invention, the inventors have provided structures, devices, and techniques which are functionally effective and which can be manufactured economically.

In various embodiments described herein, apparatus, devices, and tools are provided that can be configured for application to standard fluid containers, such as containers for cosmetic products. For example, and by way of illustration only, a standard cosmetic fluid container may have a dispensing orifice in the range of 1 mm to 1.5 mm. Accordingly, certain embodiments of the invention may be structured to accommodate such standard sizes. However, it can be appreciated that the embodiments of the invention may be modified or structured to accommodate different orifice sizes, different fluid container materials, different fluid container shapes, and/or different types of fluids or fluid viscosities. For example, embodiments of the invention may be readily modified or structured to function with an orifice dimension which is larger or smaller than a standard size orifice of a cosmetic fluid container.

In developing the invention, the inventors have recognized the advantages of leveraging existing containers such as tubes made from plastic or similar materials which typically offer a safe and effective way to deliver product. Such tubes protect the product while providing a reasonably long shelf life. Also, there are many ways to decorate a tube in order to meet a prestige or premium consumer market. In contrast, there are other types of non-tube containers that require an external pump or similar mechanical mechanism to dispense watery or less viscous fluids.

The inventors are also aware that how a product is dispensed is an important consideration in the product packaging business. For example, consumer complaints may arise because product leaked into a purse or spilled onto a blouse, or simply because the fluid container delivered a dose that was either too little or too much. In any event, the product may not dispense correctly from the fluid container, and consequently the container can be perceived as non-functional.

Also, by taking into account the demand for lower component costs, the inventors were motivated to improve on existing fluid delivery structures, techniques, and systems. It can be seen that use of certain embodiments of the invention can create opportunities for more products to be considered for the plastic tube, for example, versus other types of containers that require external, mechanical pumps, for example. The inventors recognized the importance of identifying and designing multiple options and materials, because there are many products or fluids which require different dispensing strategies. For example, the manufacture of the plastic tube has been historically limited in mass production to a 1 mm orifice. But the inventors have recognized that, for many applications, such an orifice size is not sufficiently small to effectively control the product flow or dispensing behavior from a tube-style container of certain types of fluids. This was part of the incentive for the inventors to create structures within the nozzle head, for example, to control fluid flow prior to the fluid reaching the dispensing orifice.

In developing certain embodiments of the invention, the inventors have addressed numerous issues related to providing sufficient air flow into and out of the orifice of a fluid container or fluid dispensing apparatus. For example, certain structures described herein may function as static check valves which allow sufficient air to flow through a dispensing orifice into a fluid container, while adequately retaining the fluid contents within the container until product is desired to be dispensed. Also, in the example of a standard tube-style cosmetic container, aspects of the invention can be used to enhance dispensing precision by improving the feedback relationship between pressure applied to the container (e.g., such as by manual pressure applied by a consumer) and the pressure experienced by the container in the act of dispensing a cosmetic product.

In various embodiments, the structures, tools, and techniques described herein can be configured to be completely internal or substantially completely internal with respect to a fluid container. This permits the structure and aesthetics (e.g., color, shape, size, and other characteristics) of the container to remain unaltered in the eyes of consumers examining the container from an external point of view. In addition, aspects of the present invention can be readily retrofitted to pre-existing, standard styles of fluid containers, such as tube-type cosmetic containers, for example.

As applied herein, the term "cosmetic" may include make-up, oils, creams, and a variety of other compositions of matter capable of flowing from a fluid dispenser or a fluid container, either naturally (e.g., by force of gravity) or by application of a threshold fluid pressure.

FIGS. 1 through 4 illustrate an example of an apparatus 101 structured for dispensing fluid. As shown, the apparatus 101 comprises a fluid repository 102 in fluid communication with a nozzle 104. The nozzle 104 may include one or more dispensing orifices 106 formed therein for communicating fluid from the interior of the fluid repository 102 to an external location. In various embodiments, and as shown more particularly in FIG. 1, one or more retaining ridges 108 (such as retaining ridges 108A-108F) may be positioned or formed on an interior surface of the nozzle 104.

A plug 110 may be positioned and/or supported on at least a portion of one or more of the retaining ridges 108 of the nozzle 104. In various embodiments, at least a portion of the plug 110 comprises a pathway for communicating fluid from the fluid repository 102 to the dispensing orifice 106 upon application of a threshold fluid pressure. The threshold fluid pressure may be provided by manual pressure applied to the fluid repository 102, for example, or may be provided by another type of internal or external force.

As applied to various embodiments described throughout the present description, a threshold fluid pressure may be defined as the amount of pressure sufficient to communicate at least a portion of fluid from a fluid repository, through a nozzle, and then through a dispensing orifice. In other embodiments, the threshold fluid pressure is the pressure sufficient to communicate a cosmetic-related compound, substance, or fluid from the fluid repository, through the nozzle, and then through the dispensing orifice. In various embodiments described herein, an apparatus may be structured to communicate fluid at a threshold fluid pressure that does not exceed a pressure applied to the fluid repository. In certain embodiments, an apparatus may be structured to communicate fluid at a threshold fluid pressure independent of a pressure applied to the fluid repository. In other words, certain embodiments of the invention provide a check valve type feature that does not permit excessive applied pressure to significantly impact the dispensing or dosaging performance of a fluid dispensing apparatus.

It can be seen that one or more of the retaining ridges 108 may be structured for supporting an outflow portion of the plug 110 at a predetermined gap distance 112 from the dispensing orifice 106. In various embodiments, the predetermined gap distance 112 may be selected for optimum performance in response to multiple variables such as fluid viscosity, size of the dispensing orifice 106, and/or type of fluid being dispensed, among many other factors. It can be appreciated that the gap distance 112 may be zero or substantially zero in certain embodiments, or may otherwise be a distance selected for optimizing desired performance characteristics based on fluid viscosity, for example, or other performance criteria. In various embodiments, the plug 110 may comprise a foam material such as an open-cell foam material, for example.

Figure 2:
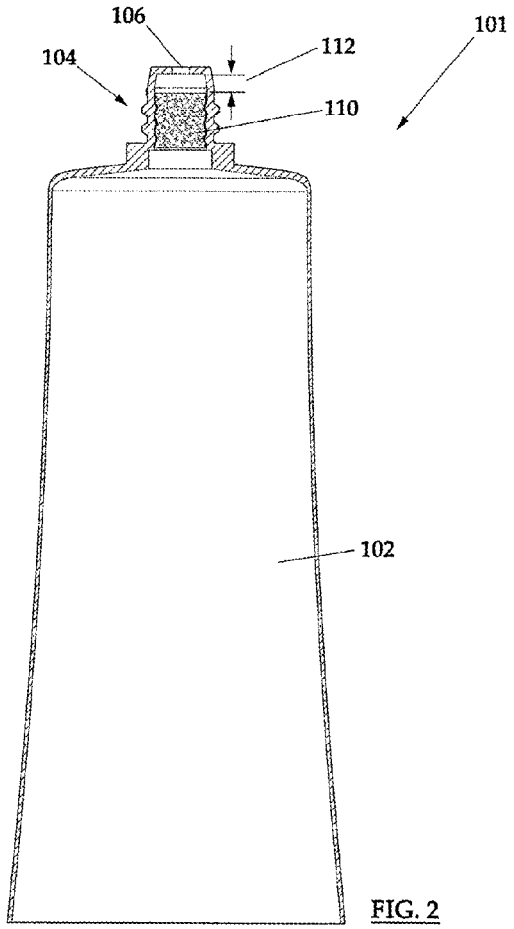
Figure 3:
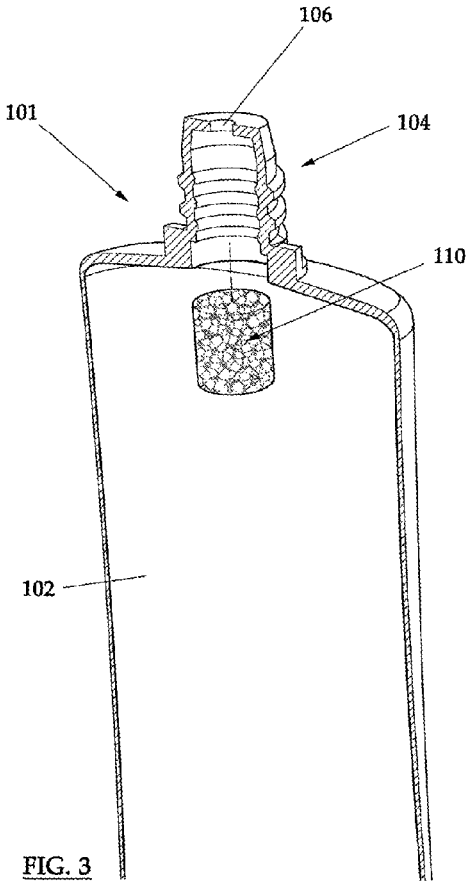
Figure 4:
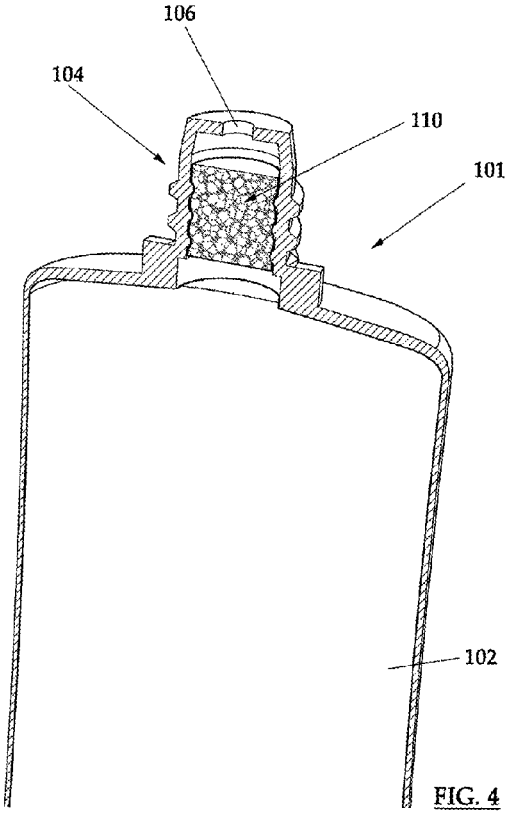

As shown, FIG. 1 includes a partially disassembled view of the apparatus 101 prior to insertion of the plug 110 into the nozzle 104 of the apparatus 101. FIG. 2 illustrates the plug 110 fully inserted and positioned within the nozzle 104 of the apparatus 101. FIG. 3 provides an alternative view of the apparatus 101 shown in FIG. 1. Likewise, FIG. 4 provides an alternative view of the apparatus 101 shown in FIG. 2.

FIGS. 5 through 8 illustrate an example of an apparatus 201 structured for dispensing fluid. As shown, the apparatus 201 comprises a fluid repository 202 in fluid communication with a nozzle 204. The nozzle 204 may include one or more dispensing orifices 206 formed therein for communicating fluid from the interior of the fluid repository 202 to an external location. In various embodiments, one or more retaining ridges 208 may be positioned or formed on an interior surface of the nozzle 204.

A plug 210 may be positioned and/or supported on at least a portion of one or more of the retaining ridges 208 of the nozzle 204. In various embodiments, at least a portion of the plug 210 comprises a pathway for communicating fluid from the fluid repository 202 to the dispensing orifice 206 upon application of a threshold fluid pressure. The threshold fluid pressure may be provided by manual pressure applied to the fluid repository 202, for example, or may be provided by another type of internal or external force. As illustrated, the retaining ridge 208 may extend around the entire circumference of the interior of the nozzle 204 to provide support to the plug 210. In certain embodiments, the retaining ridge 208 may comprise one or more segments that extend at least partially around the circumference of the interior of the nozzle 204 to provide support and/or proper positioning to the plug 210 within the nozzle 204.

It can be seen that the retaining ridge 208 may be structured for supporting an outflow portion of the plug 210 at a predetermined gap distance 212 from the dispensing orifice 206. In various embodiments, the predetermined gap distance 212 may be selected for optimum performance in response to multiple variables such as fluid viscosity, size of the dispensing orifice 206, and/or type of fluid being dispensed, among many other factors. It can be appreciated that the gap distance 212 may be zero or substantially zero in certain embodiments, or may otherwise be a distance selected for optimizing desired performance characteristics based on fluid viscosity, for example, or other performance criteria. In various embodiments, the plug 210 may comprise a foam material such as an open-cell foam material, for example.

Figure 5:
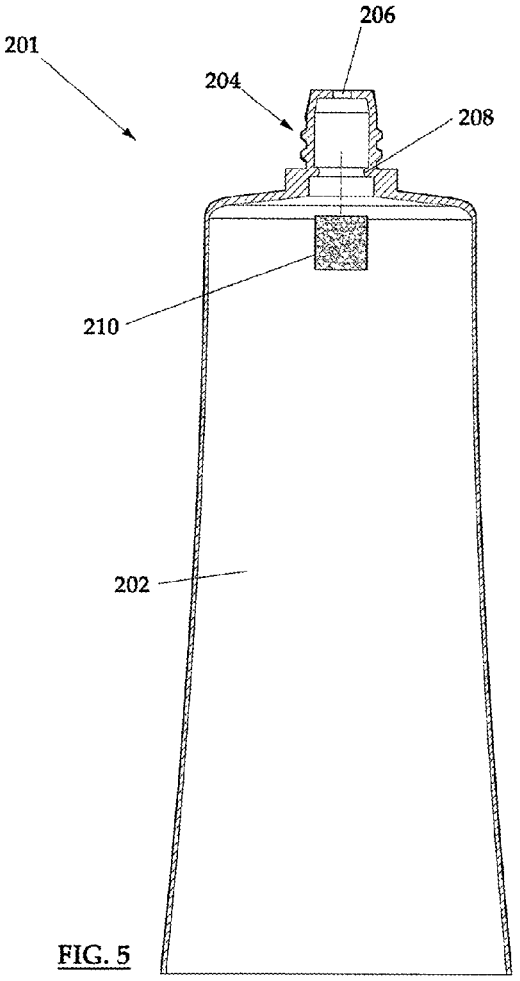
FIGS. 5 through 8 illustrate various aspects of an example of an apparatus structured for dispensing fluid in accordance with various embodiments of the invention.
Figure 6:
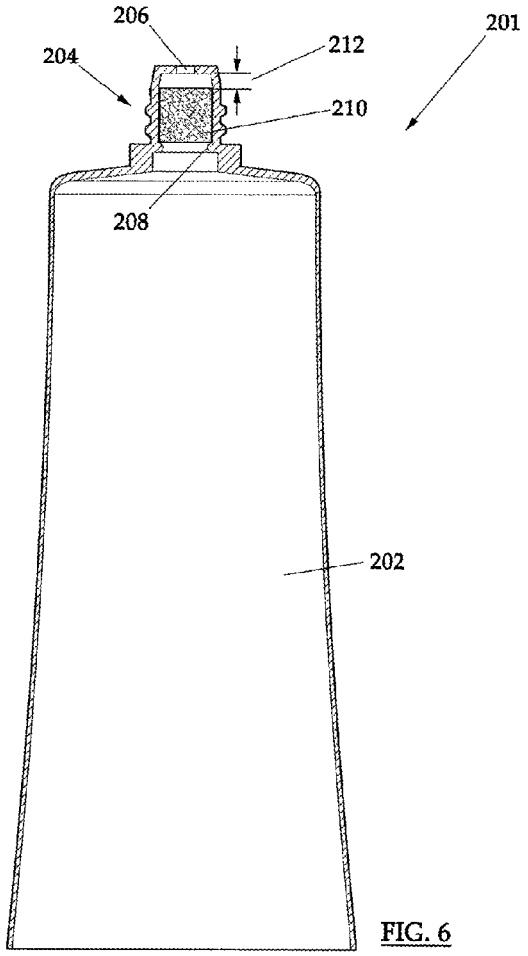
Figure 7:
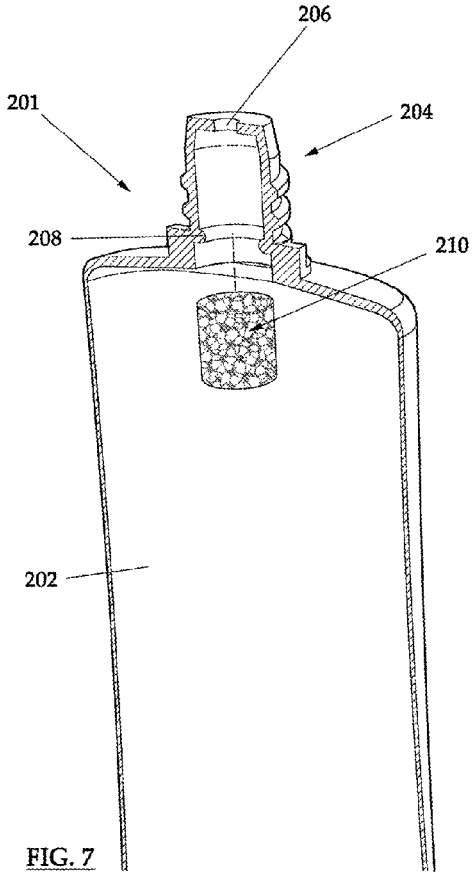
Figure 8:
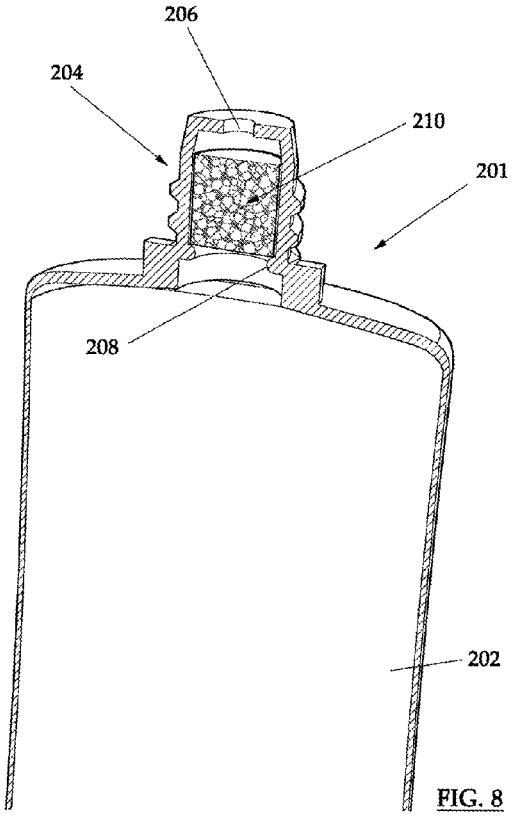

As shown, FIG. 5 includes a partially disassembled view of the apparatus 201 prior to insertion of the plug 210 into the nozzle 204 of the apparatus 201. FIG. 6 illustrates the plug 210 fully inserted and positioned within the nozzle 204 of the apparatus 201. FIG. 7 provides an alternative view of the apparatus 201 shown in FIG. 5. Likewise, FIG. 8 provides an alternative view of the apparatus 201 shown in FIG. 6.

FIGS. 9 through 12 illustrate an example of an apparatus 301 structured for dispensing fluid. As shown, the apparatus 301 comprises a fluid repository 302 in fluid communication with a nozzle 304. The nozzle 304 may include one or more dispensing orifices 306 formed therein for communicating fluid from the interior of the fluid repository 302 to an external location. In various embodiments, one or more retaining ridges 308 may be positioned or formed on an interior surface of the nozzle 304.

A plug 310 may be positioned and/or supported within a retainer 312, which in turn may be supported on at least a portion of the retaining ridge 308 of the nozzle 304. In various embodiments, at least a portion of the plug 310 comprises a pathway for communicating fluid from the fluid repository 302 to the dispensing orifice 306 upon application of a threshold fluid pressure. The threshold fluid pressure may be provided by applying manual pressure on the fluid repository 302, for example, or may be provided by another type of internal or external force. As illustrated, the retaining ridge 308 may extend around the entire circumference of the interior of the nozzle 304 to provide support and/or proper placement to the combination of the plug 310 and the retainer 312. In certain embodiments, the retaining ridge 308 may comprise one or more segments that extend at least partially around the circumference of the interior of the nozzle 304 to provide support to the plug 310. The retaining ridge 308 may be structured to receive a correspondingly mating portion or segment of the retainer 312 thereon when positioned for operation within the nozzle 304.

It can be seen that the retaining ridge 308 may be structured for supporting the retainer 312 including an outflow portion of the plug 310 at a predetermined gap distance 314 from the dispensing orifice 306. In various embodiments, the predetermined gap distance 314 may be selected for optimum performance in response to multiple variables such as fluid viscosity, size of the dispensing orifice 306, type of fluid being dispensed, among many other factors. It can be appreciated that the gap distance 314 may be zero or substantially zero in certain embodiments, or may otherwise be a distance selected for optimizing desired performance characteristics based on fluid viscosity, for example, or other performance criteria. In various embodiments, the plug 310 may comprise a foam material such as an open-cell foam material, for example. It can be seen that the plug 310 may be positioned within at least a portion of the interior of the retainer 312, wherein at least a portion of the plug 310 can be shaped to conform to an interior shape of the retainer 312.

Figure 9:
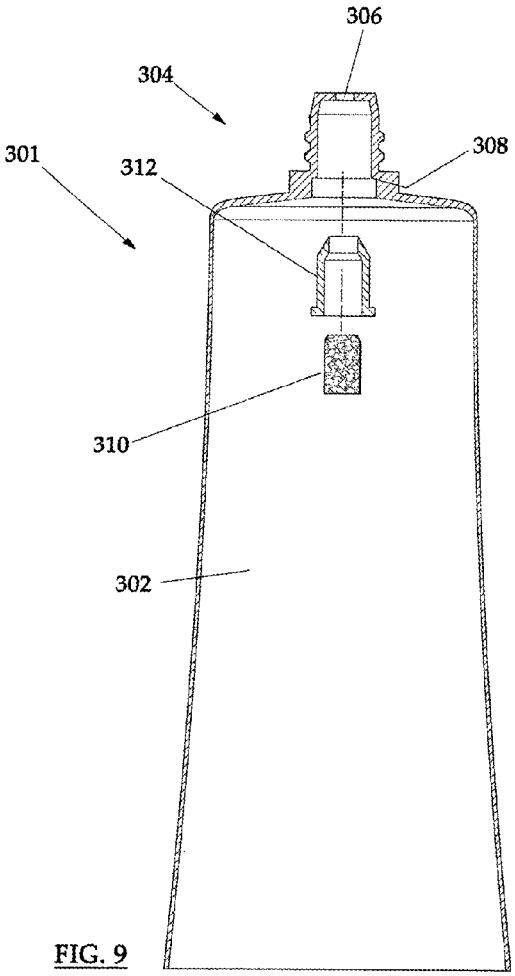
FIGS. 9 through 12 illustrate various aspects of an example of an apparatus structured for dispensing fluid in accordance with various embodiments of the invention.
Figure 10:
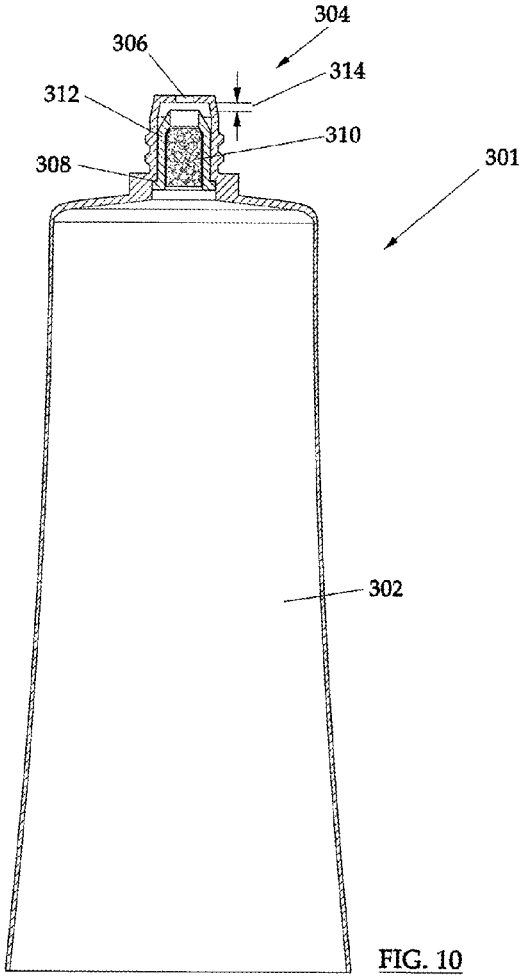
Figure 11:
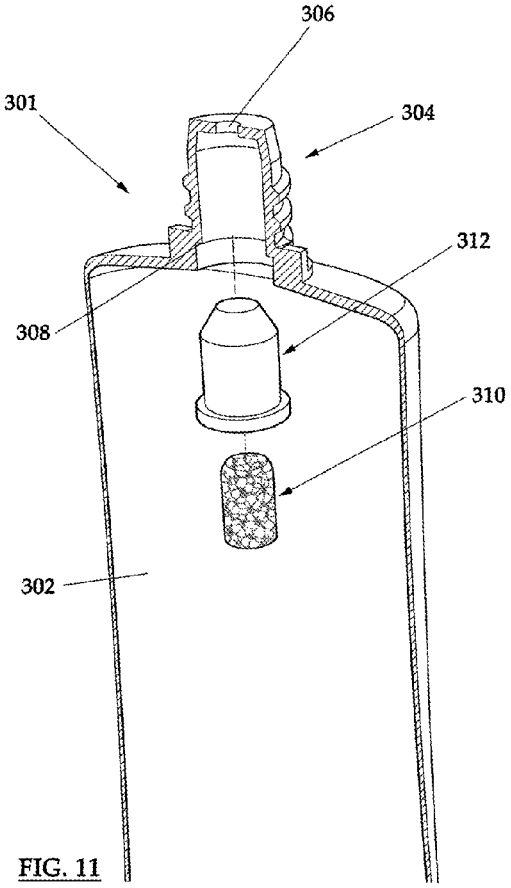
Figure 12:
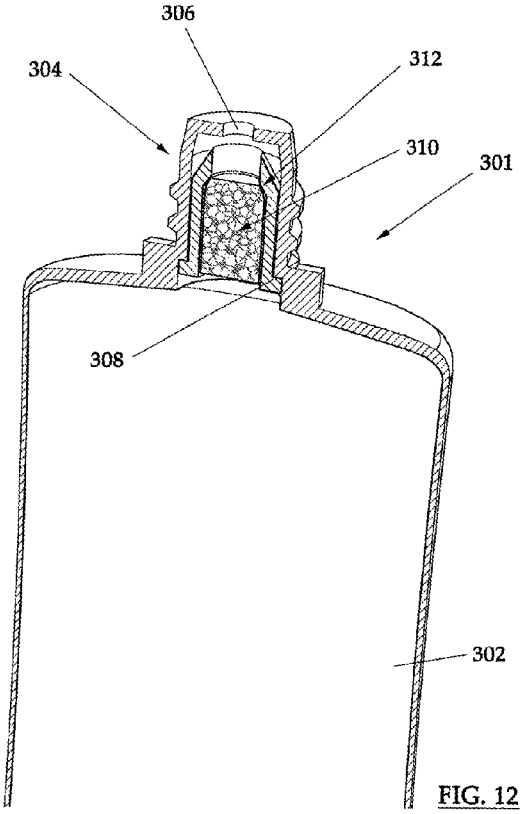

As shown, FIG. 9 includes a partially disassembled view of the apparatus 301 prior to combination of the plug 310 with the retainer 312 and then insertion of the retainer 312 into the nozzle 304 for support by the retaining ridge 308 of the apparatus 301. FIG. 10 illustrates the combined retainer 312 and plug 310 assembly inserted and positioned within the nozzle 304 of the apparatus 301. FIG. 11 provides an alternative view of the apparatus 301 shown in FIG. 9. Likewise, FIG. 12 provides an alternative view of the apparatus 301 shown in FIG. 10.

Figure 13:
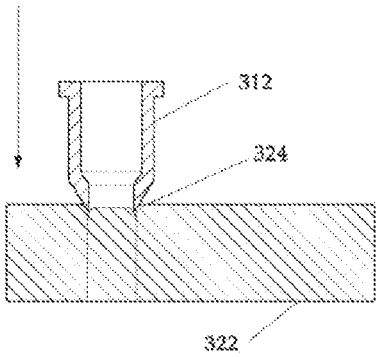
FIGS. 13 and 14 illustrate an example of a method for manufacturing and assembling a combined plug and retainer assembly, in accordance with various embodiments of the invention.
Figure 14:
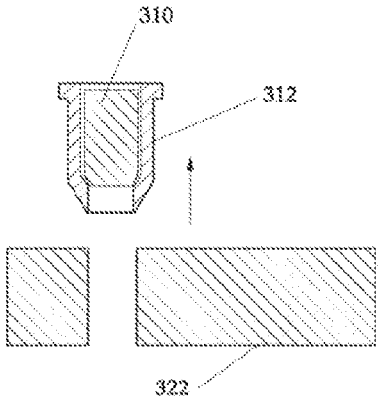

FIGS. 13 and 14 illustrate a method for manufacturing and assembling a combined plug 310 and retainer 312 assembly, in accordance with various embodiments of the invention. FIG. 13 illustrates a retainer 312 positioned over a block of foam material 322. The block of foam material 322 may be positioned on a machine or work bench, for example, or as part of a production line in a manufacturing facility. As shown, a top portion 324 of the retainer 312 cuts into the block of foam material 322 to cut and force an amount of the foam material into a shape conforming to the interior space of the retainer 312. The act of cutting into the foam material 322 may be performed by a machine, for example, or other mechanism that holds the retainer 312 in place over the foam material 322, and then presses the retainer 312 with sufficient force to penetrate and cut the foam material 322. As illustrated in FIG. 14, after the cutting and forming process is complete, the retainer 312 can be withdrawn from the block of material 322. The plug 310 is now formed and contained within the interior of the retainer 312 to provide the combined retainer 312 and plug 310 assembly. It can be seen that this combined method of manufacturing and assembling the combined plug 310 can provide economic advantages in the form of reduced tooling costs and labor costs, for example.

Figure 15:
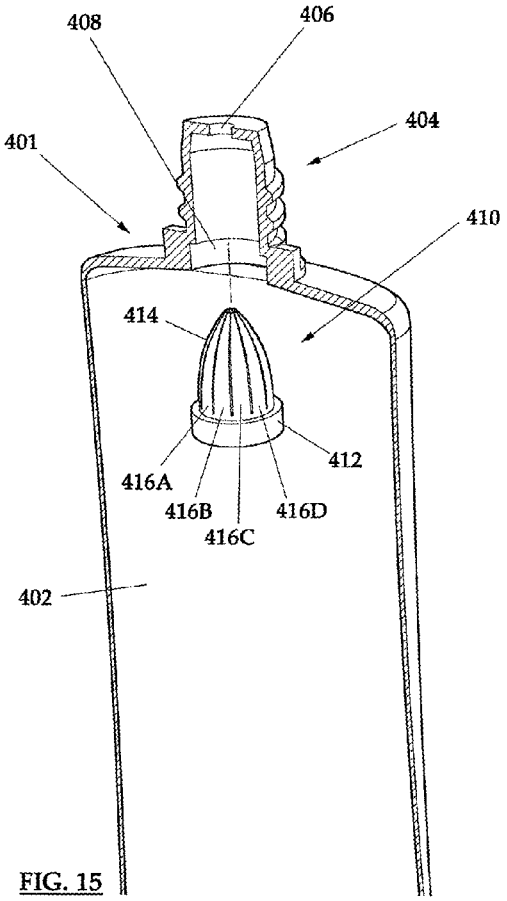
FIGS. 15 and 16 illustrate an example of an apparatus structured for dispensing fluid in accordance with various embodiments of the invention.
Figure 16:
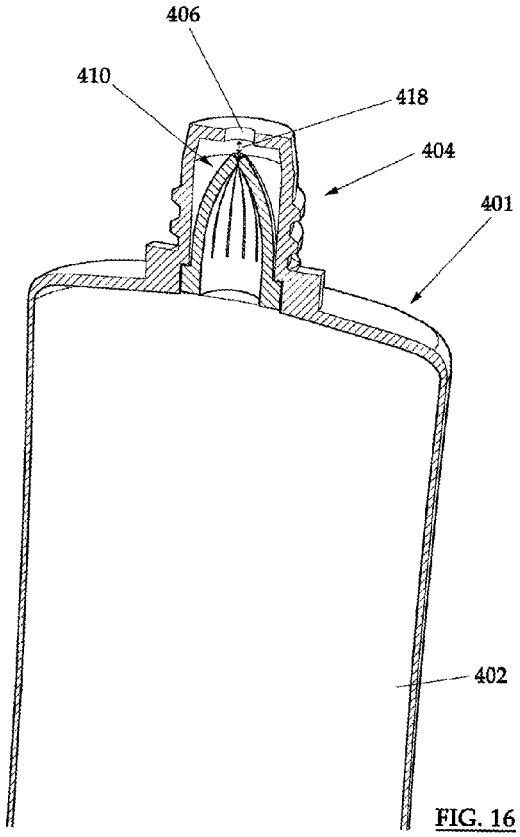

FIGS. 15 and 16 illustrate an example of an apparatus 401 structured for dispensing fluid. As shown, the apparatus 401 comprises a fluid repository 402 in fluid communication with a nozzle 404. The nozzle 404 may include one or more dispensing orifices 406 formed therein for communicating fluid from the interior of the fluid repository 402 to an external location. In various embodiments, one or more retaining ridges 408 may be positioned or formed on an interior surface of the nozzle 404 for supporting or positioning various structures within the nozzle 404.

Figure 17:
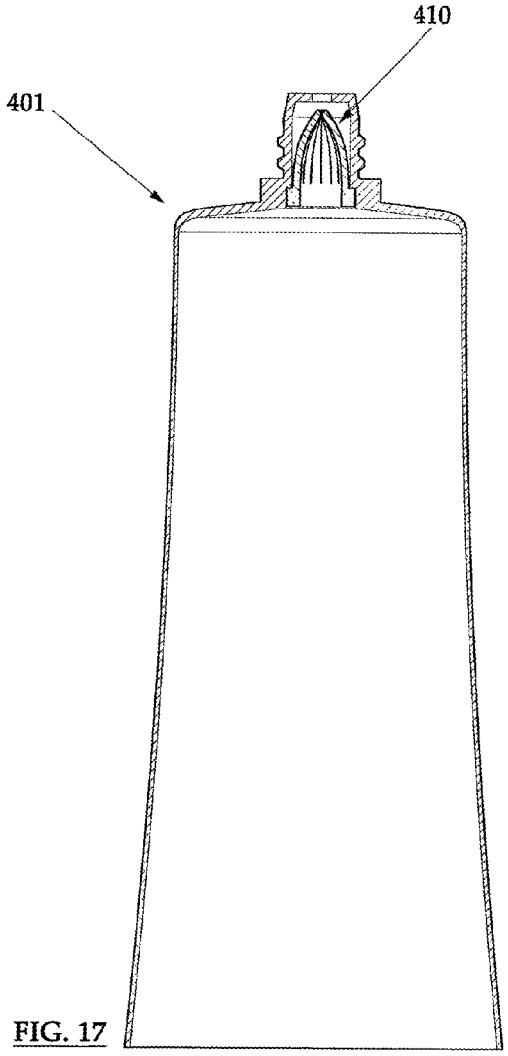
FIG. 17 illustrates an example of the fingers of a plug in a closed state.
Figure 18:
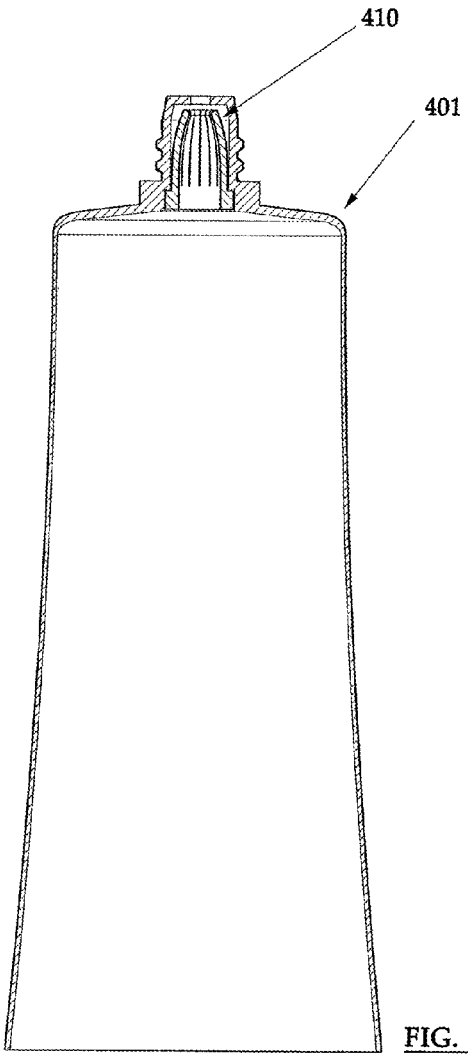
FIG. 18 illustrates an example of the fingers of a plug in an open state.

In various embodiments, a plug 410 may be positioned and/or supported on at least a portion of the retaining ridge 408 of the nozzle 404. In operation, the plug 410 may be positioned within at least a portion of the interior of the nozzle 404. The plug may include a base 412 and a tip 414 comprising a plurality of fingers 416 (e.g., fingers 416A-416D) extending from the base 412. In certain embodiments, the fingers 416 may be structured to be resiliently biased in a closed state (as shown in FIG. 17, for example) in the absence of a threshold fluid pressure applied within the interior of the plug 410. In addition, the plurality of fingers 416 may be structured to extend outwardly from the interior of the plug 410 in an open state to create a pathway for communicating fluid from the fluid repository 402 to the dispensing orifice 406 upon application of a threshold fluid pressure within the interior of the plug 410 (see FIG. 18, for example). At least one of the fingers 416 may be structured to flex outwardly from a longitudinal axis of the plug 410 upon application of a threshold fluid pressure within the interior of the plug 410.

In certain embodiments, one or more of the plurality of fingers 416 may comprise one or more types of fiber bristles, such as the types of fiber that can be used in a paint brush, for example. In certain embodiments, the number of the plurality of fingers 416 may be selected to allow the plug 410 to retain fluid of a certain viscosity in the absence of exceeding a threshold fluid pressure within the interior of the plug 410. Also, the length or other dimension of one or more of the fingers 416 may be selected to allow the plug 410 to retain fluid of a certain viscosity in the absence of exceeding a threshold fluid pressure within the interior of the plug 410.

In various embodiments, at least a portion of the plug 410 comprises a pathway for communicating fluid from the fluid repository 402 to the dispensing orifice 406 upon application of a threshold fluid pressure. The threshold fluid pressure may be provided by manual pressure applied to the fluid repository 402, for example, or may be provided by another type of internal or external force. As illustrated, the retaining ridge 408 may extend around the entire circumference of the interior of the nozzle 404 to provide support to the plug 410. In certain embodiments, the retaining ridge 408 may comprise one or more segments that extend at least partially around the circumference of the interior of the nozzle 404 to provide support and/or proper positioning to the plug 410. The retaining ridge 408 may be structured to receive a correspondingly mating portion of the base 412 of the plug 410 when positioned for operation within the nozzle 404. The plug 410 may be positioned in place within the nozzle 404 by use of a friction fit, a suitable adhesive, or another device or method known to those skilled in the art.

It can be seen that the retaining ridge 408 may be structured for supporting an outflow portion of the plug 410 at a predetermined gap distance 418 from the dispensing orifice 406. In various embodiments, the predetermined gap distance 418 may be selected for optimum performance in response to multiple variables such as fluid viscosity, size of the dispensing orifice 406, and/or type of fluid being dispensed, among many other factors. It can be appreciated that the gap distance 418 may be zero or substantially zero in certain embodiments, or may otherwise be a distance selected for optimizing desired performance characteristics based on fluid viscosity, for example, or other performance criteria.

Figure 20B:
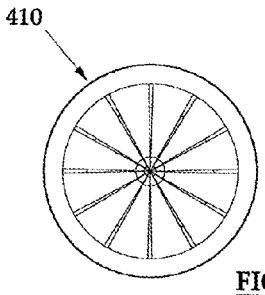
FIGS. 19 through 20B illustrate alternative views of an example of a plug structured in accordance with various embodiments of the invention.
Figure 19:
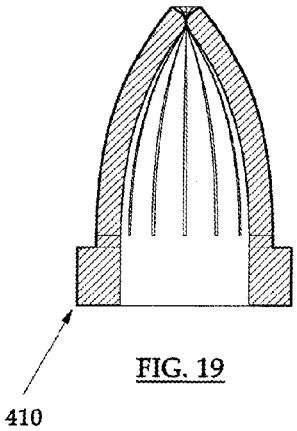
Figure 20A:
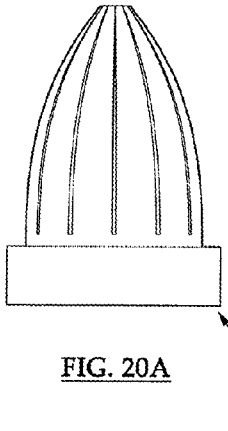

FIGS. 19 through 20B illustrate various alternative views of an example of the plug 410 as structured in accordance with various embodiments of the invention. FIG. 19 illustrates a partially cut away side view of the plug 410 in a closed state. FIG. 20A illustrates a front view of the plug 410 in a closed state. FIG. 20B shows a top view of the plug 410 of FIG. 20A.

Figure 21B:
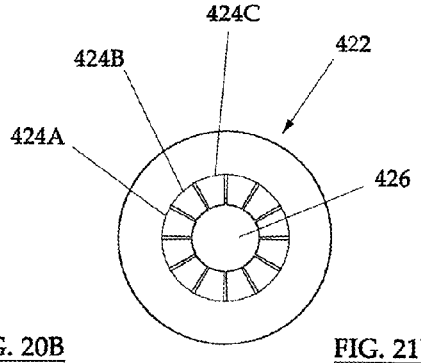
FIGS. 21A through 22B illustrate alternative views of an example of a plug structured in accordance with various embodiments of the invention.
Figure 21A:
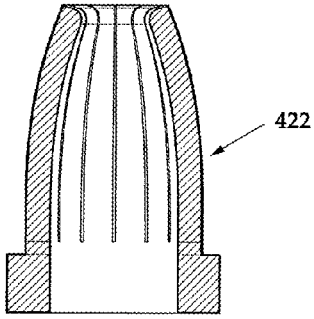
Figure 22B:
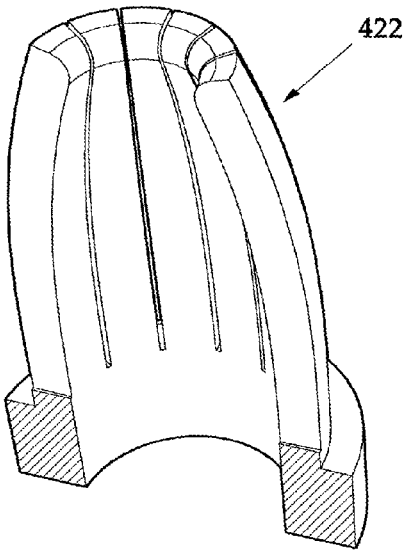
Figure 22A:
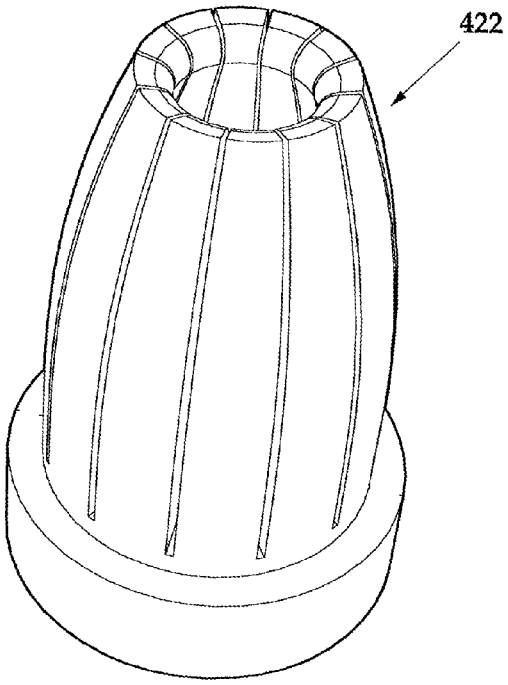

FIGS. 21A and 21B depict an alternative embodiment of a plug 422 in a closed state. As shown, each of the plurality of fingers 424 (such as fingers 424A-424C) is structured to form an opening 426 in the closed state of the plug 422. It can be appreciated that the fingers 424 can be structured (e.g., thickness, length, material type, or other characteristic) to yield certain dimensions of the opening 426 (e.g., radius, circumference, etc.) that are suitable for fluid of a given type, viscosity, flow rate, threshold fluid pressure, and/or other criteria. FIG. 21B illustrates a top view of the plug 422 shown in FIG. 21A. FIGS. 22A and 22B include alternative views of the plug 422 in a closed state.

Figure 23:
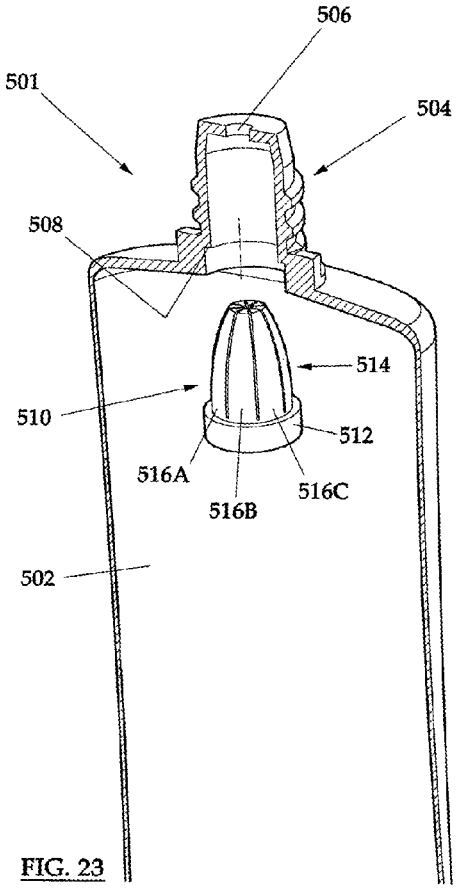
FIGS. 23 and 24 illustrate an example of an apparatus structured for dispensing fluid in accordance with embodiments of the invention.
Figure 24:
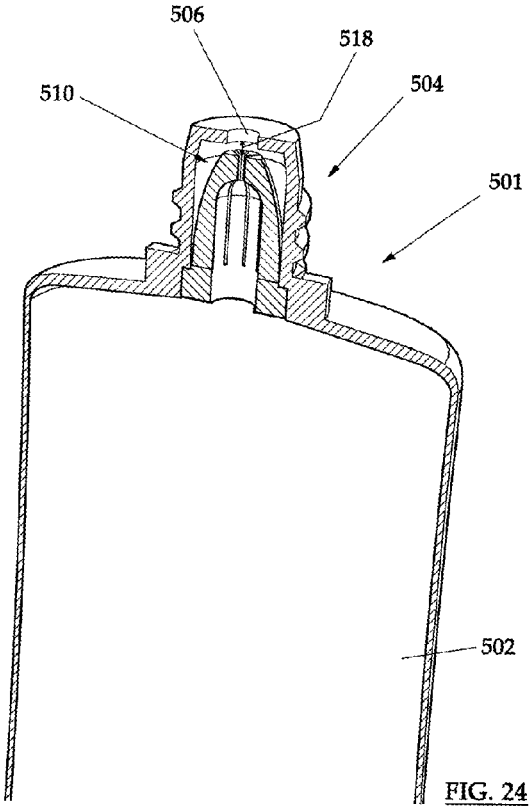

FIGS. 23 and 24 illustrate an example of an apparatus 501 structured for dispensing fluid. As shown, the apparatus 501 comprises a fluid repository 502 in fluid communication with a nozzle 504. The nozzle 504 may include one or more dispensing orifices 506 formed therein for communicating fluid from the interior of the fluid repository 502 to an external location. In various embodiments, one or more retaining ridges 508 may be positioned or formed on an interior surface of the nozzle 504 for supporting or positioning various structures within the nozzle 504.

Figure 25:
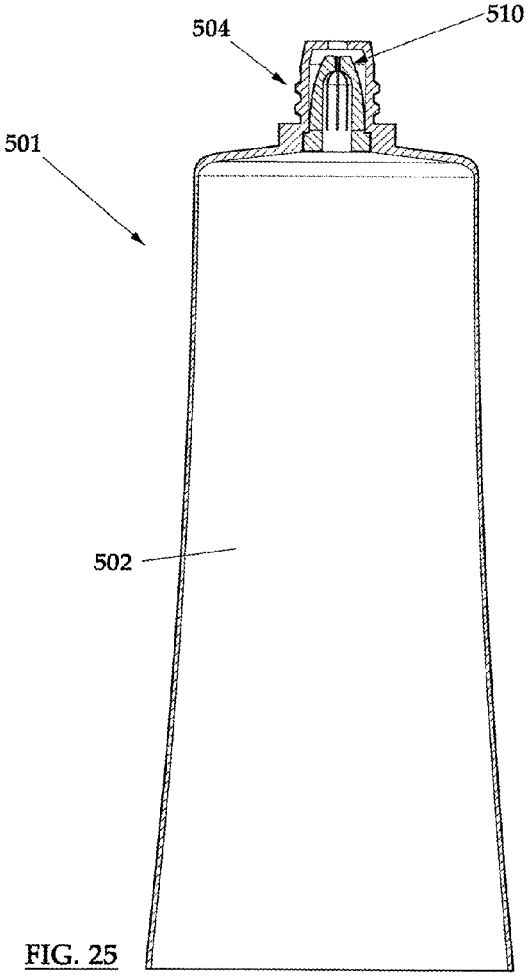
FIG. 25 illustrates an example of the fingers of a plug in a closed state.
Figure 26:
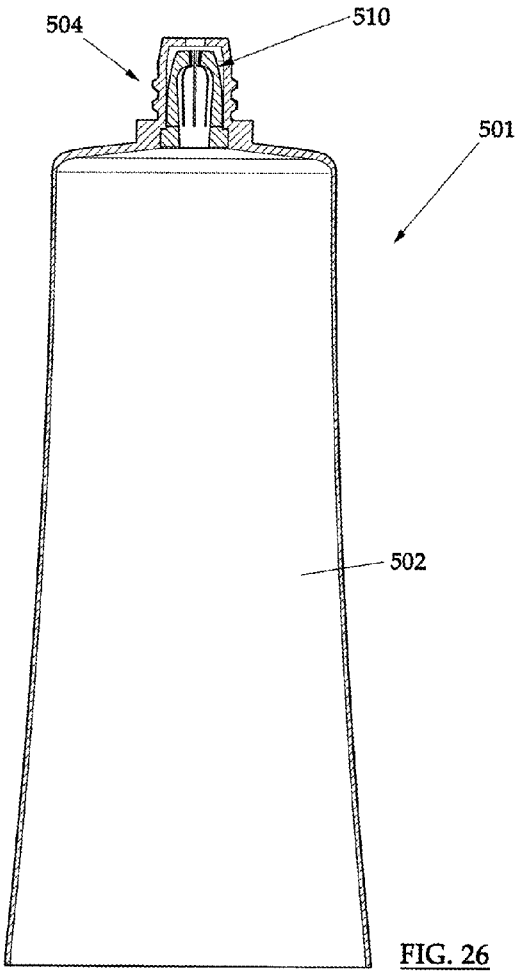
FIG. 26 illustrates an example of the fingers of a plug in an open state.

In various embodiments, a plug 510 may be positioned and/or supported on at least a portion of the retaining ridge 508 of the nozzle 504. In operation, the plug 510 may be positioned within at least a portion of the interior of the nozzle 504. The plug may include a base 512 and a tip 514 comprising a plurality of fingers 516 (e.g., fingers 516A-516C) extending from the base 512. In certain embodiments, the fingers 516 may be structured to be resiliently biased in a closed state (as shown in FIG. 25, for example) in the absence of a threshold fluid pressure applied within the interior of the plug 510. In addition, the plurality of fingers 516 may be structured to extend outwardly from the interior of the plug 510 in an open state to create a pathway for communicating fluid from the fluid repository 502 to the dispensing orifice 506 upon application of a threshold fluid pressure within the interior of the plug 510 (see FIG. 26, for example). At least one of the fingers 516 may be structured to flex outwardly from a longitudinal axis of the plug 510 upon application of a threshold fluid pressure within the interior of the plug 510.

In certain embodiments, one or more of the plurality of fingers 516 may comprise a foam material. For example, the foam material may include a closed-cell or micro fiber material, among other types of foam materials.

In certain embodiments, the number of the plurality of fingers 516 may be selected to allow the plug 510 to retain fluid of a certain viscosity in the absence of exceeding a threshold fluid pressure within the interior of the plug 510. Also, the length or other dimension of one or more of the fingers 516 may be selected to allow the plug 510 to retain fluid of a certain viscosity in the absence of exceeding a threshold fluid pressure within the interior of the plug 510.

In various embodiments, at least a portion of the plug 510 comprises a pathway for communicating fluid from the fluid repository 502 to the dispensing orifice 506 upon application of a threshold fluid pressure. The threshold fluid pressure may be provided by manual pressure applied to the fluid repository 502, for example, or may be provided by another type of internal or external force. As illustrated, the retaining ridge 508 may extend around the entire circumference of the interior of the nozzle 504 to provide support to the plug 510. In certain embodiments, the retaining ridge 508 may comprise one or more segments that extend at least partially around the circumference of the interior of the nozzle 504 to provide support and/or proper placement to the plug 510. The retaining ridge 508 may be structured to receive a correspondingly mating portion of the base 512 of the plug 510 when positioned for operation within the nozzle 504. The plug 510 may be positioned in place within the nozzle 504 by use of a friction fit, a suitable adhesive, or another device or method known to those skilled in the art.

It can be seen that the retaining ridge 508 may be structured for supporting an outflow portion of the plug 510 at a predetermined gap distance 518 from the dispensing orifice 506. In various embodiments, the predetermined gap distance 518 may be selected for optimum performance in response to multiple variables such as fluid viscosity, size of the dispensing orifice 506, and/or type of fluid being dispensed, among many other factors. It can be appreciated that the gap distance 518 may be zero or substantially zero in certain embodiments, or may otherwise be a distance selected for optimizing desired performance characteristics based on fluid viscosity, for example, or other performance criteria.

Figure 27B:
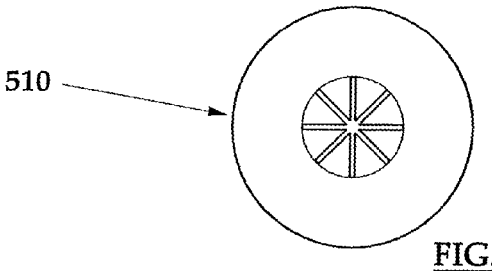
FIGS. 27A through 28B illustrate alternative views of an example of a plug structured in accordance with various embodiments of the invention.
Figure 27A:
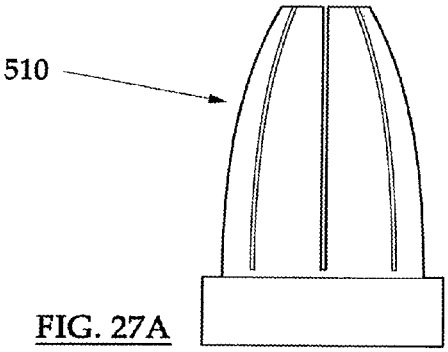
Figure 27D:
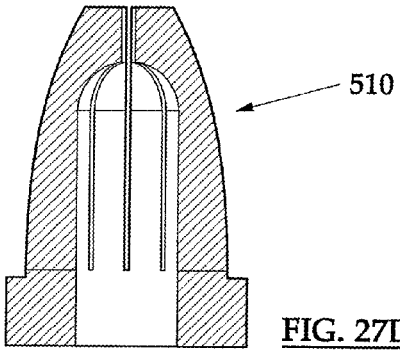
Figure 27C:
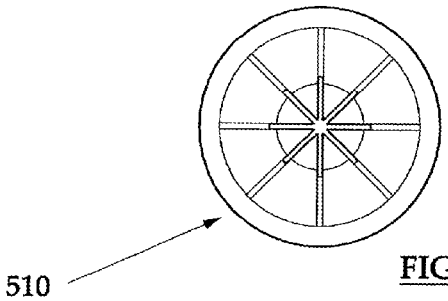
Figure 28B:
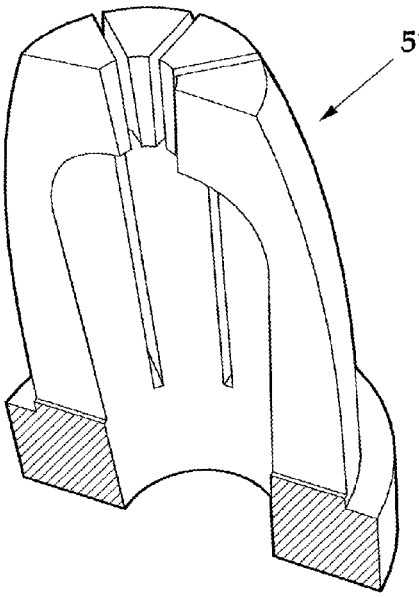
Figure 28A:
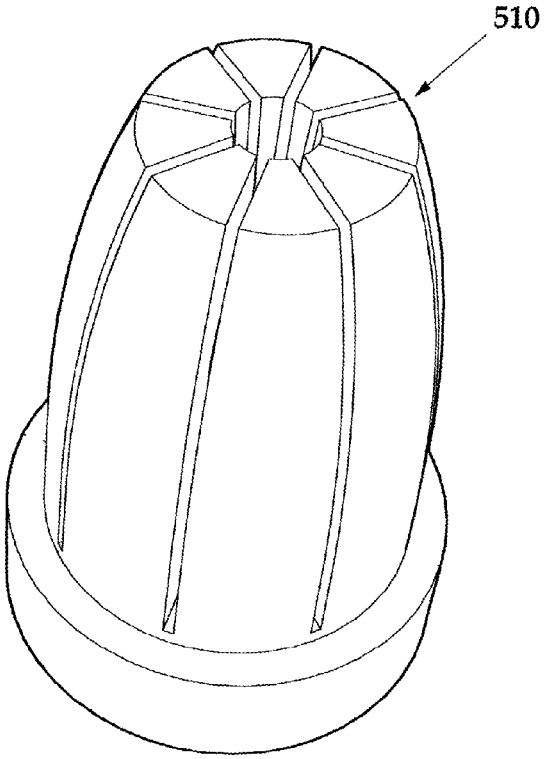

FIGS. 27A through 28B illustrate various alternative views of an example of the plug 510 as structured in accordance with various embodiments of the invention. FIG. 27A includes a front view of the plug 510 in a closed state. FIG. 27B illustrates a top view of the plug 510 of FIG. 27A, and FIG. 27C illustrates a bottom view of the plug 510 of FIG. 27A. FIG. 27D depicts a partially cut away sectional view of the plug 510 of FIG. 27A. FIGS. 28A and 28B provide additional three-dimensional views of the plug 510.

Figure 29:
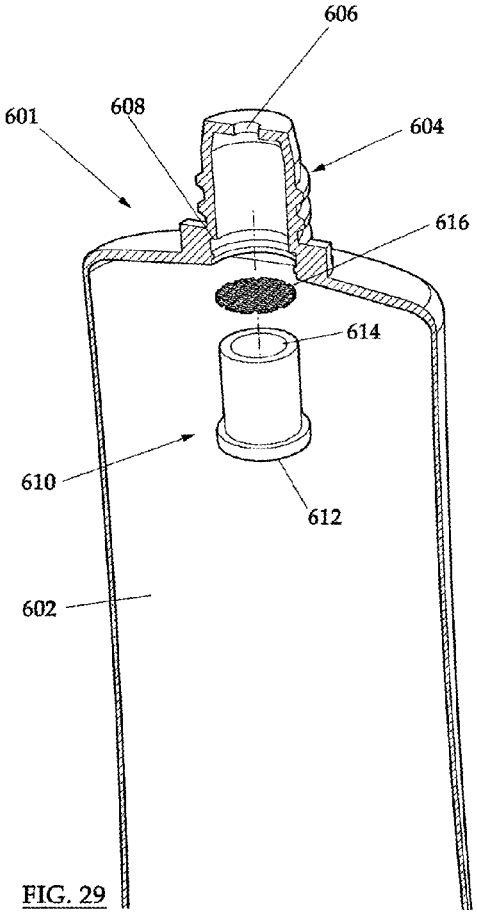
FIGS. 29 and 30 illustrate an example of an apparatus structured for dispensing fluid in accordance with various embodiments of the invention.
Figure 30:
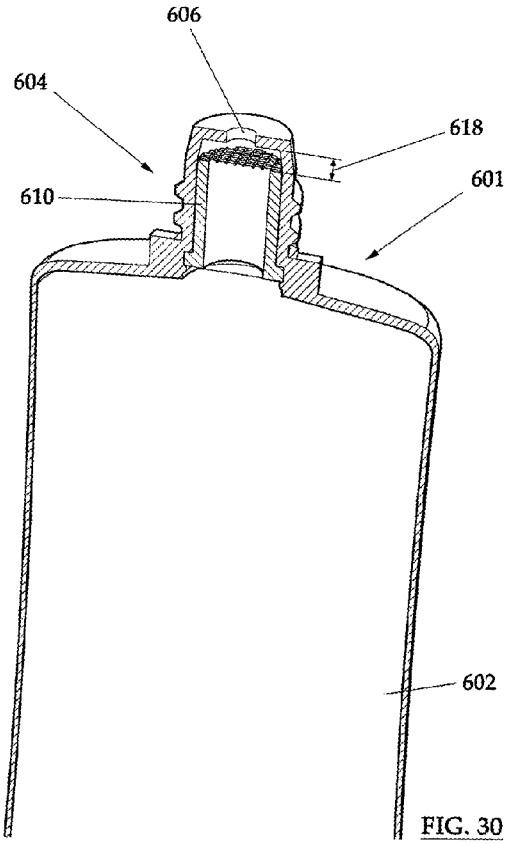

FIGS. 29 and 30 illustrate an example of an apparatus 601 structured for dispensing fluid. As shown, the apparatus 601 comprises a fluid repository 602 in fluid communication with a nozzle 604. The nozzle 604 may include one or more dispensing orifices 606 formed therein for communicating fluid from the interior of the fluid repository 602 to an external location. In various embodiments, one or more retaining ridges 608 may be positioned or formed on an interior surface of the nozzle 604 for supporting or positioning various structures within the nozzle 604. In various embodiments, a plug 610 may be positioned and/or supported on at least a portion of the retaining ridge 608 of the nozzle 604. In operation, the plug 610 may be positioned within at least a portion of the interior of the nozzle 604.

The plug 610 may include an inflow region 612 and an outflow region 614. A filter screen 616 may be positioned between the outflow region 614 of the plug 610 and the dispensing orifice 606. The filter screen 616 may be structured to create a pathway for communicating fluid from the fluid repository 602 to the dispensing orifice 606 upon application of a threshold fluid pressure.

In various embodiments, the filter screen 616 may be affixed to at least a portion of the outflow region 614 of the plug 610, such as by heat sealing, adhesive, or another method or device known to those skilled in the art. In one embodiment, the filter screen 616 may be positioned to float within the space between the outflow region 614 of the plug 610 and the dispensing orifice 606. In another embodiment, the filter screen 616 may be wedged into place within a portion of an interior space of the plug 610. In the example illustrated, the filter screen 616 may include a plurality of cross-hatched openings formed therein. In certain embodiments, the cross-sectional area of one or more of the openings may be selected to sufficiently communicate therethrough a fluid having a predetermined viscosity.

In various embodiments, at least a portion of the plug 610 comprises a pathway for communicating fluid from the fluid repository 602 to the dispensing orifice 606 upon application of a threshold fluid pressure. The threshold fluid pressure may be provided by manual pressure applied to the fluid repository 602, for example, or may be provided by another type of internal or external force. As illustrated, the retaining ridge 608 may extend around the entire circumference of the interior of the nozzle 604 to provide support and/or proper placement to the plug 610. In certain embodiments, the retaining ridge 608 may comprise one or more segments that extend at least partially around the circumference of the interior of the nozzle 604 to provide support to the plug 610. The retaining ridge 608 may be structured to receive a correspondingly mating portion or segment of the plug 610 when positioned for operation within the nozzle 604. The plug 610 may be positioned in place within the nozzle 604 by use of a friction fit, a suitable adhesive, or another device or method known to those skilled in the art.

It can be seen that the retaining ridge 608 may be structured for supporting the outflow region 614 of the plug 610 at a predetermined gap distance 618 from the dispensing orifice 606. In various embodiments, the predetermined gap distance 618 may be selected for optimum performance in response to multiple variables such as fluid viscosity, size of the dispensing orifice 606, type of fluid being dispensed, among many other factors. It can be appreciated that the gap distance 618 may be zero or substantially zero in certain embodiments, or may otherwise be a distance selected for optimizing desired performance characteristics based on fluid viscosity, for example, or other performance criteria.

Figure 31:
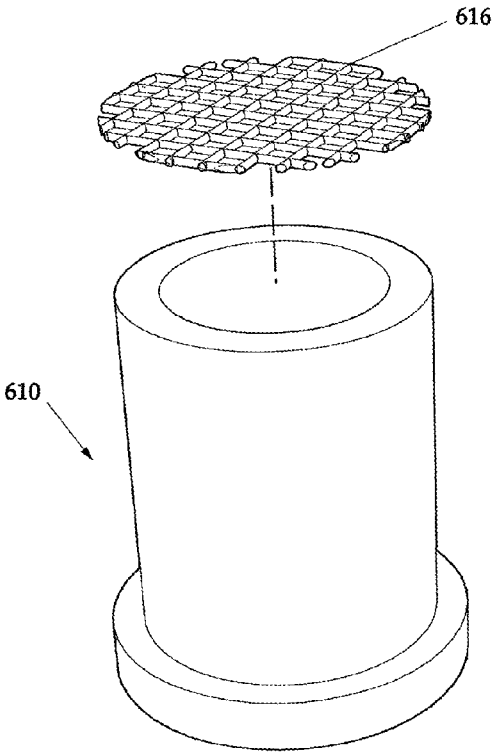
FIGS. 31 through 33B illustrate various alternative views of an example of a plug and filter screen assembly structured in accordance with various embodiments of the invention.
Figure 32:
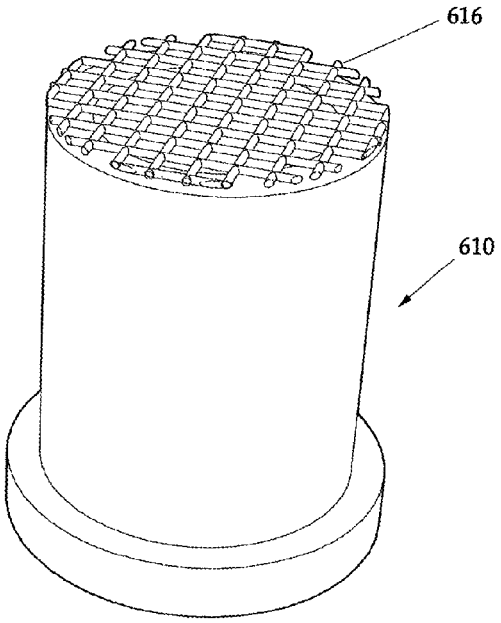
Figure 33B:
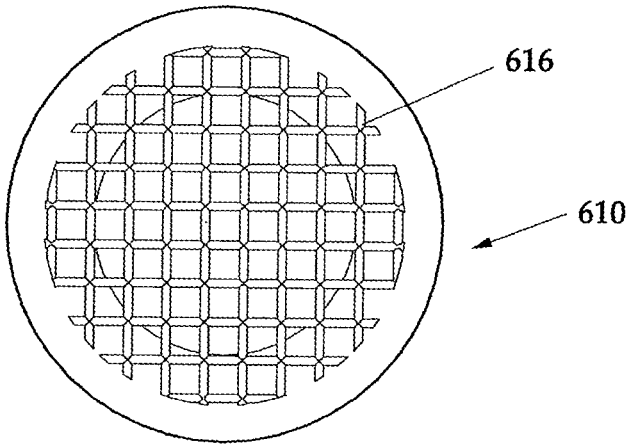
Figure 33A:
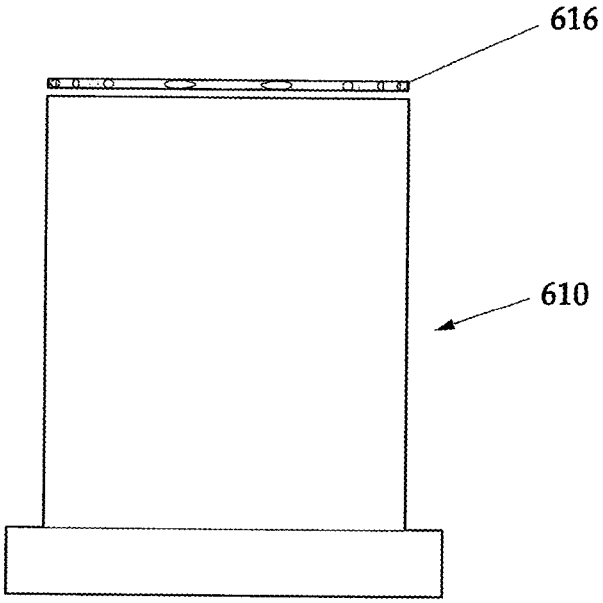

FIGS. 31 through 33B illustrate various alternative views of an example of the plug 610 and the filter screen 616 as structured in accordance with various embodiments of the invention. FIG. 31 includes an exploded view of the plug 610 and filter screen 616 assembly, and FIG. 32 includes an assembled view of the plug 610 with the filter screen 616 attached to the plug 610. FIG. 33A includes a side plan view of the plug 610 and filter screen 616 arrangement, and FIG. 33B includes a top view of the plug 610 and filter screen 616 arrangement.

Figure 34:
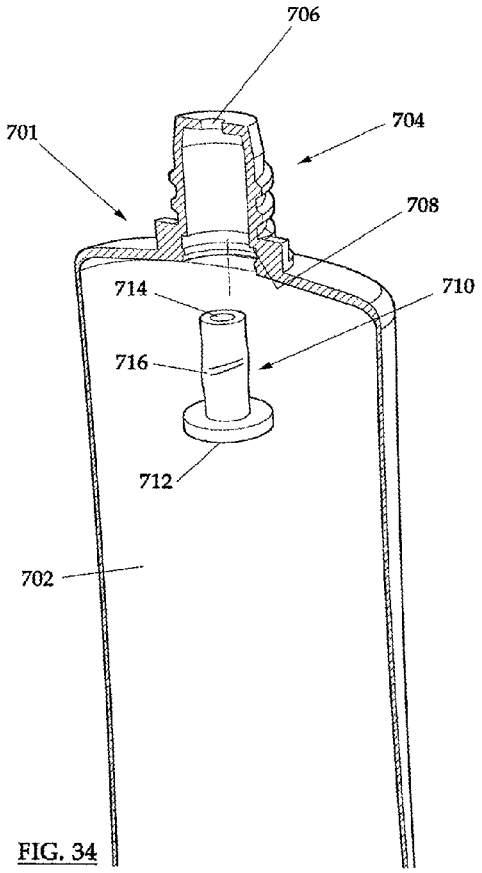
FIGS. 34 and 35 illustrate an example of an apparatus structured for dispensing fluid in accordance with various embodiments of the invention.
Figure 35:
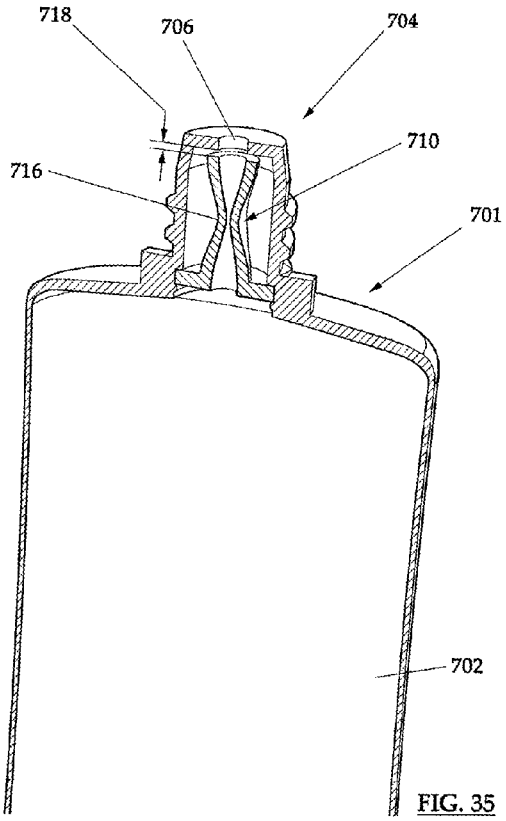

FIGS. 34 and 35 illustrate an example of an apparatus 701 structured for dispensing fluid. As shown, the apparatus 701 comprises a fluid repository 702 in fluid communication with a nozzle 704. The nozzle 704 may include one or more dispensing orifices 706 formed therein for communicating fluid from the interior of the fluid repository 702 to an external location. In various embodiments, one or more retaining ridges 708 may be positioned or formed on an interior surface of the nozzle 704 for supporting or positioning various structures within the nozzle 704. In various embodiments, a plug 710 may be positioned and/or supported on at least a portion of the retaining ridge 708 of the nozzle 704. In operation, the plug 710 may be positioned within at least a portion of the interior of the nozzle 704.

In various embodiments, the plug 710 may include an inflow region 712, an outflow region 714, and a constriction region 716 positioned between the inflow region 712 and the outflow region 714. It can be seen that the plug 710 establishes a two-way pathway for fluid communication between the inflow region 712 and the outflow region 714. In certain embodiments, at least a portion of the outflow region 714 of the plug 710 may be positioned for direct contact and fluid communication with the dispensing orifice 706. It can be appreciated that the cross-sectional area and/or volumetric space defined by all or a portion of the constriction region 716 can be configured to communicate therethrough a fluid having a predetermined viscosity and/or to provide a desired flow rate through the apparatus 701. In one embodiment, an example of the plug 710 includes a tube-shaped portion having a crimped segment formed at a location between the inflow region 712 and the outflow region 714 for establishing the constriction region 716. At least a portion of the plug 710 may comprise an elastomeric material or another type of material for forming the constriction region 716 therein. For example, the constriction region 716 may be formed by heat sealing or crimping the plug 710 between the inflow and outflow regions 712, 714 to form the constriction region 716.

In various embodiments, at least a portion of the plug 710 comprises a pathway for communicating fluid from the fluid repository 702 to the dispensing orifice 706 upon application of a threshold fluid pressure. The threshold fluid pressure may be provided by manual pressure applied to the fluid repository 702, for example, or may be provided by another type of internal or external force. As illustrated, the retaining ridge 708 may extend around the entire circumference of the interior of the nozzle 704 to provide support and/or proper placement of the plug 710. In certain embodiments, the retaining ridge 708 may comprise one or more segments that extend at least partially around the circumference of the interior of the nozzle 704 to provide support to the plug 710. The retaining ridge 708 may be structured to receive a correspondingly mating portion or segment of the plug 710 when positioned for operation within the nozzle 704. The plug 710 may be positioned in place within the nozzle 704 by use of a friction fit, a suitable adhesive, or another device or method known to those skilled in the art.

It can be seen that the retaining ridge 708 may be structured for supporting the outflow region 714 of the plug 710 at a predetermined gap distance 718 from the dispensing orifice 706. In various embodiments, the predetermined gap distance 718 may be selected for optimum performance in response to multiple variables such as fluid viscosity, size of the dispensing orifice 706, and/or type of fluid being dispensed, among many other factors. It can be appreciated that the gap distance 718 may be zero or substantially zero in certain embodiments, or may otherwise be a distance selected for optimizing desired performance characteristics based on fluid viscosity, for example, or other performance criteria.

Figure 36:
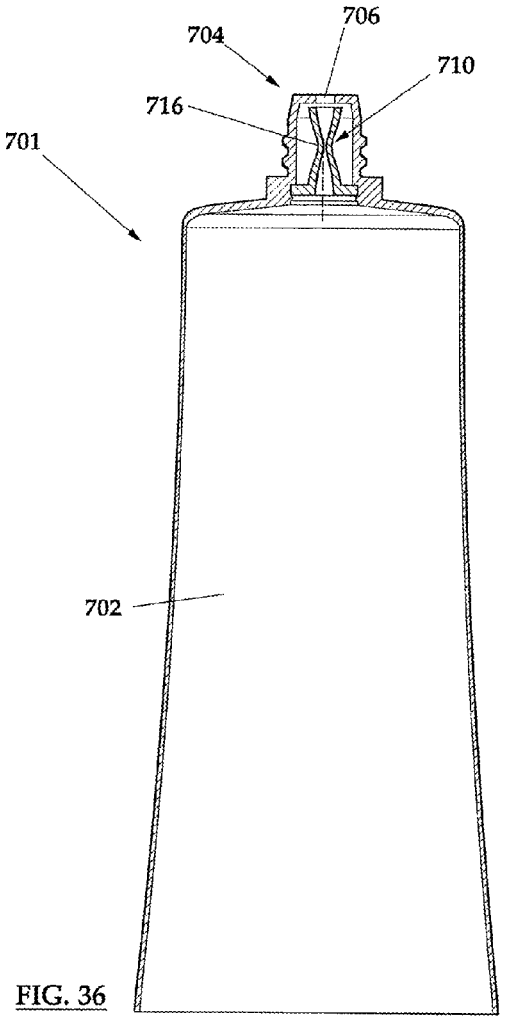
FIG. 36 illustrates an example of a plug positioned for operation within a nozzle.
Figure 37:
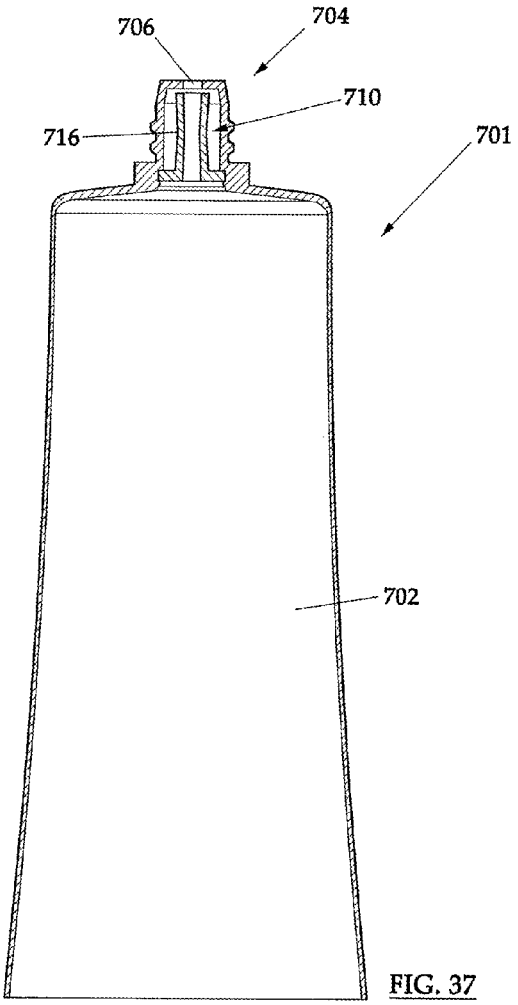
FIG. 37 illustrates the effect of applying a threshold fluid pressure to the interior of the plug of FIG. 36.

FIG. 36 illustrates the plug 710 positioned for operation within the nozzle 704 of the apparatus in a pre-pressurized state or condition. FIG. 37 illustrates the effect of applying a threshold fluid pressure to the interior of the plug 710. As shown, the constriction region 716 of the plug 710 expands outwardly from the interior of the plug 710 to allow fluid to flow therethrough from the fluid reservoir 702 to the dispensing orifice 706 of the apparatus 701.

Figure 38C:
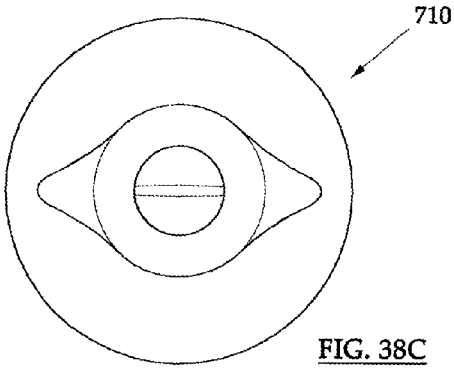
FIGS. 38A through 38C illustrate alternative views of a plug as structured in accordance with various embodiments of the invention.
Figure 38A:
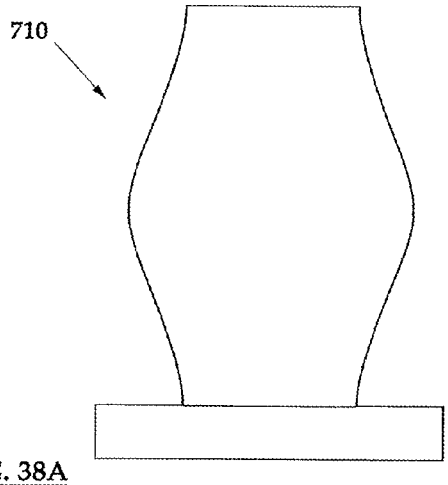
Figure 38B:
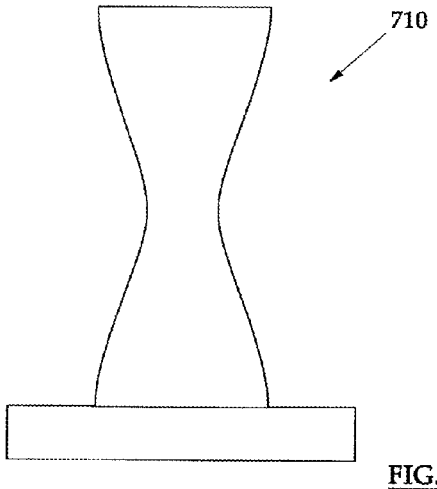

FIGS. 38A through 38C illustrate various alternative views of an example of the plug 710 as structured in accordance with various embodiments of the invention. FIG. 38A includes a front view of the plug 710. FIG. 38B includes a side view of the plug 710 shown in FIG. 38A. FIG. 38C depicts a top view of the plug 710 as shown in FIG. 38A.

Figure 39:
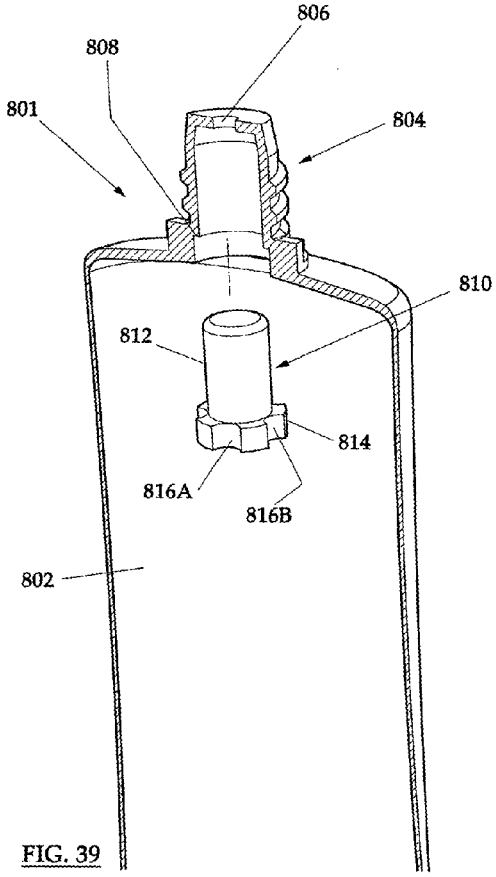
FIGS. 39 and 40 illustrate an example of an apparatus structured for dispensing fluid in accordance with various embodiments of the invention.
Figure 40:
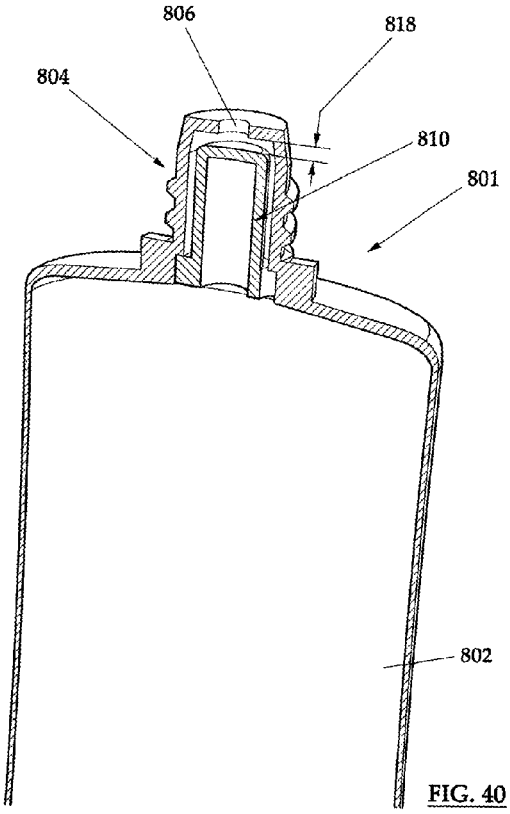

FIGS. 39 and 40 illustrate an example of an apparatus 801 structured for dispensing fluid. As shown, the apparatus 801 comprises a fluid repository 802 in fluid communication with a nozzle 804. The nozzle 804 may include one or more dispensing orifices 806 formed therein for communicating fluid from the interior of the fluid repository 802 to an external location. In various embodiments, one or more retaining ridges 808 may be positioned or formed on an interior surface of the nozzle 804 for supporting or positioning various structures within the nozzle 804. In various embodiments, a plug 810 may be positioned and/or supported on at least a portion of the retaining ridge 808 of the nozzle 804. In operation, the plug 810 may be positioned within at least a portion of the interior of the nozzle 804.

In various embodiments, the plug 810 may include a tip 812 and a base 814 having one or more longitudinal openings 816 (such as openings 816A, 816B) formed therein. Each of the longitudinal openings 816 may be structured to create a pathway for communicating fluid from the fluid repository 802 to the dispensing orifice 806 upon application of a threshold fluid pressure within the apparatus 801. It can be appreciated that the cross-sectional area and/or volumetric space defined by all or a portion of the openings 816 can be configured to communicate therethrough a fluid having a predetermined viscosity and/or to provide a desired flow rate through the apparatus 801.

In various embodiments, at least a portion of the plug 810 comprises a pathway for communicating fluid from the fluid repository 802 to the dispensing orifice 806 upon application of a threshold fluid pressure. The threshold fluid pressure may be provided by manual pressure applied to the fluid repository 802, for example, or may be provided by another type of internal or external force. As illustrated, the retaining ridge 808 may extend around the entire circumference of the interior of the nozzle 804 to provide support and/or proper placement of the plug 810. In certain embodiments, the retaining ridge 808 may comprise one or more segments that extend at least partially around the circumference of the interior of the nozzle 804 to provide support to the plug 810. The retaining ridge 808 may be structured to receive a correspondingly mating portion or segment of the base 814 of the plug 810 when positioned for operation within the nozzle 804. The plug 810 may be positioned in place within the nozzle 804 by use of a friction fit, a suitable adhesive, or another device or method known to those skilled in the art.

It can be seen that the retaining ridge 808 may be structured for supporting an outflow region of the plug 810 at a predetermined gap distance 818 from the dispensing orifice 806. In various embodiments, the predetermined gap distance 818 may be selected for optimum performance in response to multiple variables such as fluid viscosity, size of the dispensing orifice 806, and/or type of fluid being dispensed, among many other factors. It can be appreciated that the gap distance 818 may be zero or substantially zero in certain embodiments, or may otherwise be a distance selected for optimizing desired performance characteristics based on fluid viscosity, for example, or other performance criteria.

Figure 41C:
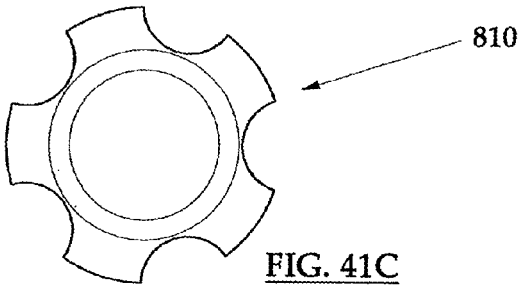
FIGS. 41A through 41D illustrate alternative views of an example of a plug structured in accordance with various embodiments of the invention.
Figure 41A:
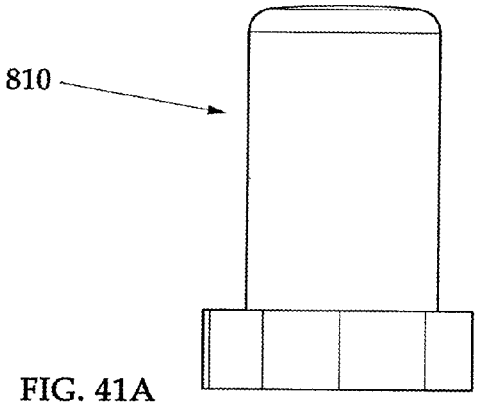
Figure 41B:
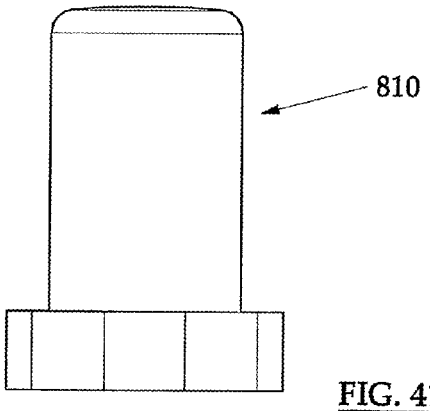
Figure 41D:
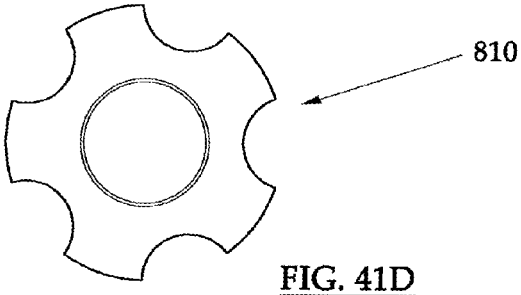

FIGS. 41A through 41D illustrate various alternative views of an example of the plug 810 as structured in accordance with various embodiments of the invention. FIG. 41A includes a front view of the plug 810, and FIG. 41B includes a side view of the plug 810 shown in FIG. 41A. FIG. 41C illustrates a top view of the plug 810 shown in FIG. 41A, and FIG. 41D shows a bottom view of the plug 810 included in FIG. 41A.

Figure 42:
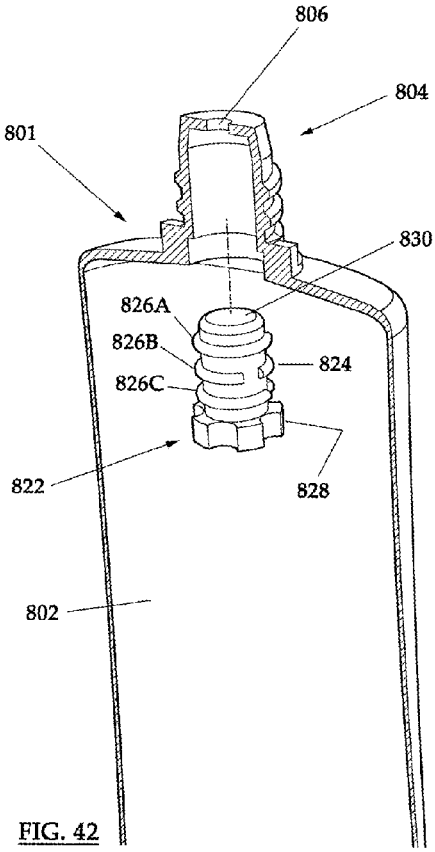
FIGS. 42 and 43 illustrate an example of an apparatus including a plug modified to include a tortured path.
Figure 43:
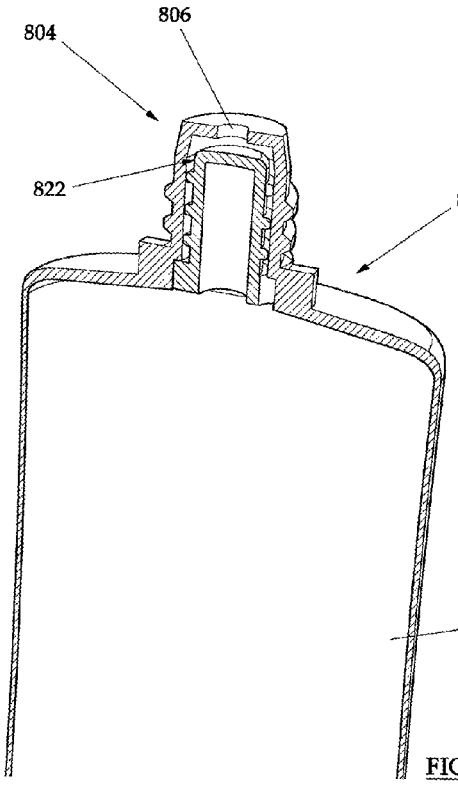

In alternative embodiments, FIGS. 42 and 43 illustrate an example of the apparatus 801 including a plug 822 modified to include a tortured path 824 formed thereon. In the example shown, the tortured path 824 comprises a plurality of segments 826 (such as segments 826A-826C) defining gaps between the segments 826 to provide a tortured and potentially circuitous path for fluid to travel from the fluid repository 802 to the dispensing orifice 806 upon application of threshold fluid pressure. As shown, the tortured path 824 may comprise a plurality of segments 826 positioned on the plug 822 generally transversely with respect to a longitudinal axis of the plug 822. In addition, one or more of the plurality of segments 826 may have a thickness which is a predetermined percentage of the overall height of the plug 822, or which is a predetermined percentage of the distance from a portion of the base 828 of the plug 822 to the endmost portion of the tip 830 of the plug 822, or another selected dimension.

Figure 44C:
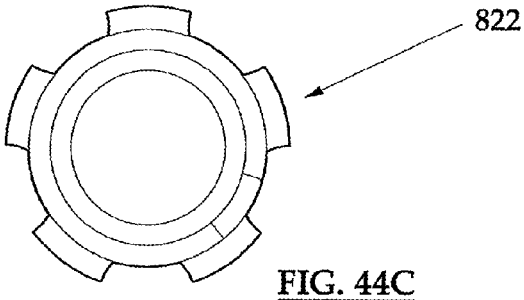
FIGS. 44A through 44D illustrate alternative views of an example of a plug including a tortured path structured in accordance with various embodiments of the invention.
Figure 44A:
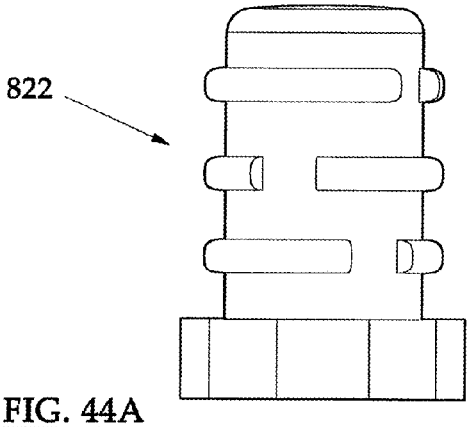
Figure 44B:
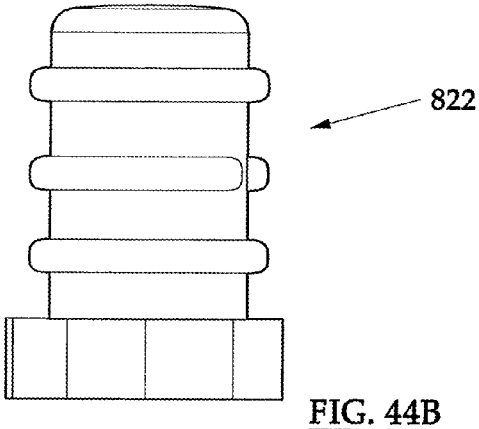
Figure 44D:
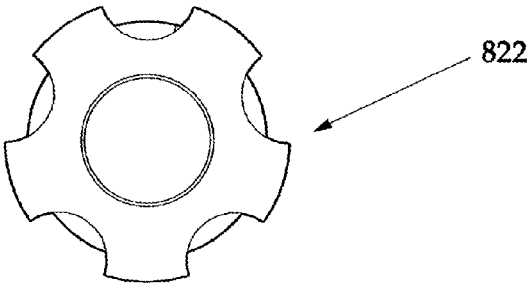
Figure 45:
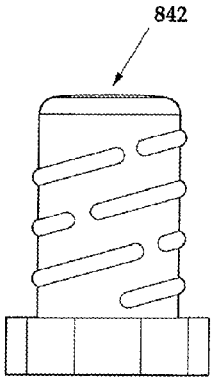
FIGS. 45 through 48 include alternative examples of plugs including different configurations for tortured paths.
Figure 46:
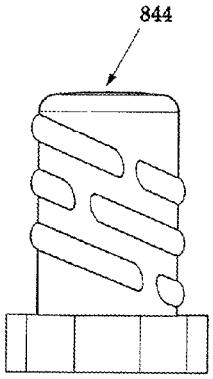
Figure 47:
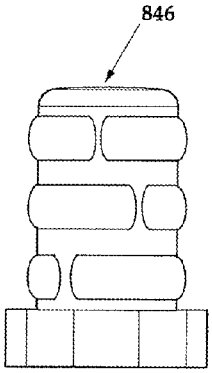
Figure 48:
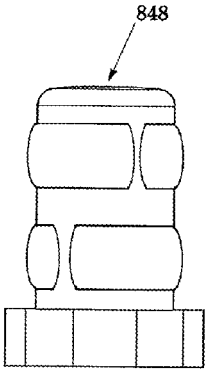

FIGS. 44A through 44D illustrate various alternative views of an example of the plug 822 including the tortured path 824 as structured in accordance with various embodiments of the invention. FIG. 44A includes a front view of the plug 822, and FIG. 44B includes a side view of the plug 822 shown in FIG. 44A. FIG. 44C illustrates a top view of the plug 822 shown in FIG. 44A, and FIG. 44D shows a bottom view of the plug 822 included in FIG. 44A.

In addition, FIGS. 45 through 48 include alternative examples of plugs 842, 844, 846, 848 including different configurations for tortured paths that may be employed in connection with a plug. For example, the plugs 842, 844 illustrated in FIGS. 45 and 46 include tortured paths comprised of a plurality of segments positioned at an angle with respect to a longitudinal axis of the plugs 842, 844. In comparing plug 846 to plug 848, it can be seen that the segments of the tortured path for plug 846 are generally less thick than the segments of the tortured path for plug 848. In this example, plug 848 has an additional row of segments formed on the plug 848 as compared to the plug 846. It can be appreciated that a wide variety of tortured path configurations may be possible within the scope of embodiments of the invention described herein. The tortured path may be configured into response to fluid viscosity, material type, desired flow rate, desired dosage, and/or many other factors.

Figure 49:
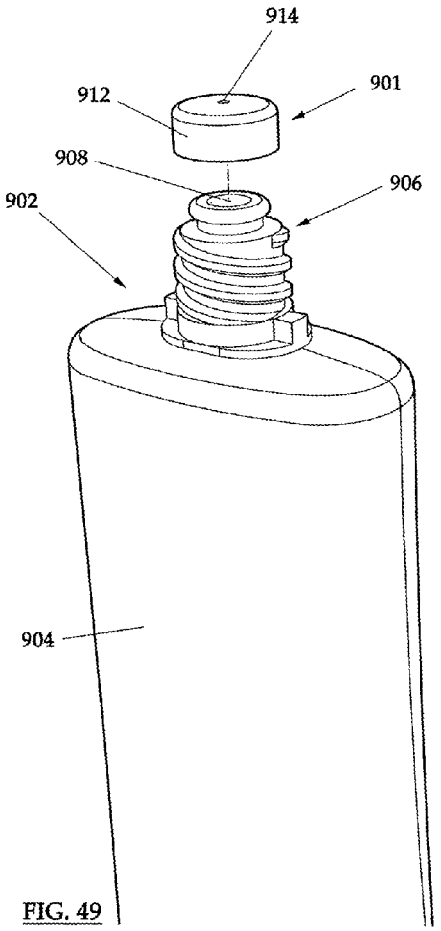
FIGS. 49 and 50 illustrate an example of a covering apparatus structured for use in connection with a fluid dispensing apparatus.
Figure 50:
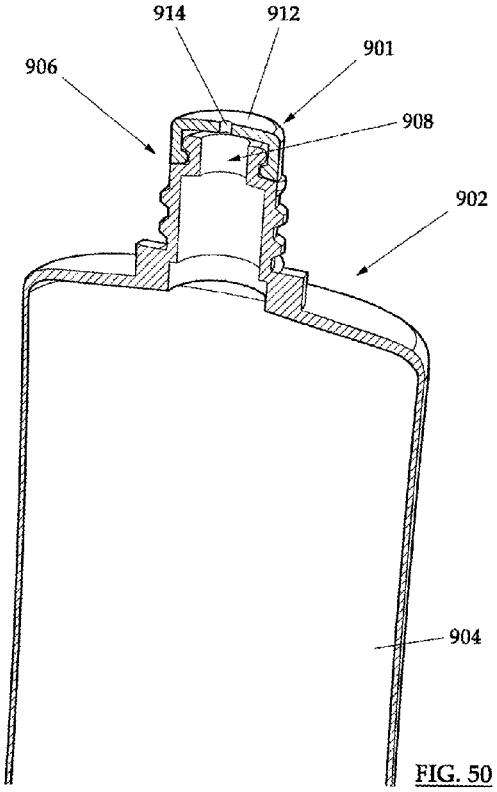

FIGS. 49 and 50 illustrate an example of a covering apparatus 901 structured for use in connection with a fluid dispensing apparatus 902. As shown, the fluid dispensing apparatus 902 comprises a fluid repository 904 in fluid communication with a nozzle 906. The nozzle 906 may include one or more dispensing orifices 908 formed therein for communicating fluid from the interior of the fluid repository 904 to an external location.

In various embodiments, the covering apparatus 901 may include a housing 912 structured for placement on the fluid dispensing apparatus 902. The housing 912 may be structured for attaching to and covering at least a portion of the nozzle 906 of the fluid dispensing apparatus 901. In addition, the covering apparatus 901 may include one or more supplemental dispensing orifices 914 formed in the housing 912. In operation, at least a portion of the supplemental dispensing orifice 914 can be structured to overlap with at least a portion of the dispensing orifice 908 of the fluid dispensing apparatus 902 when the housing 912 is positioned on the fluid dispensing apparatus 902.

In various embodiments, the housing 912 of the covering apparatus 901 may comprise a flexible material or an elastomeric material, for example. The housing 912 may also comprise a material having a color representative of contents of the fluid dispensing apparatus 902 (e.g., a certain type of cosmetic). A total area of the supplemental dispensing orifices 914 may be configured to be less than the area of the dispensing orifice 908 of the fluid dispensing apparatus 902. A ratio of an area of the supplemental dispensing orifice 914 to an area of the dispensing orifice 908 of the fluid dispensing apparatus 902 may be selected within a predetermined range subject to material viscosity, fluid material type, desired fluid flow rate, desired dosage to be dispensed, and/or many other factors.

Figure 51A:
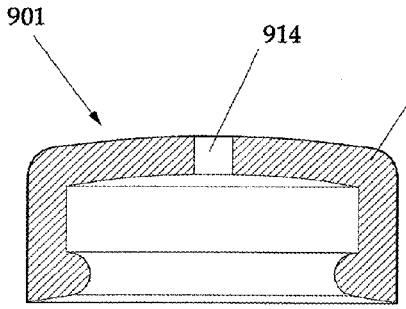
FIGS. 51A through 51C illustrate various alternative views of an example of a covering apparatus structured in accordance with various embodiments of the invention.
Figure 51B:
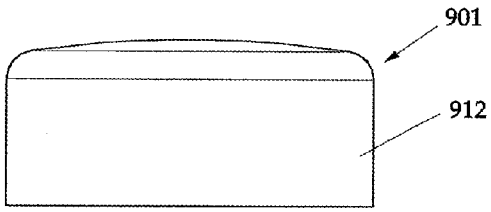
Figure 51C:
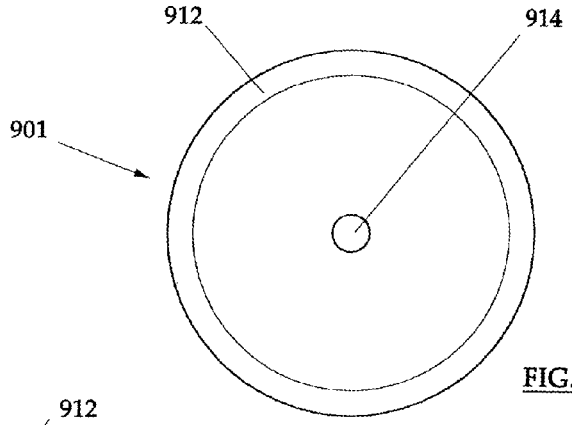
Figure 52:
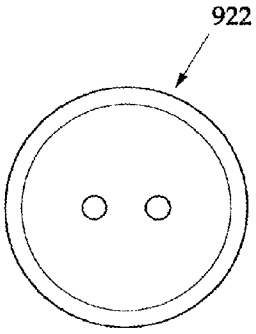
FIGS. 52 through 54 illustrate alternative styles of covering apparatuses structured in accordance with certain embodiments of the invention.
Figure 53:
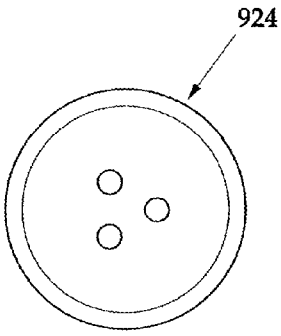
Figure 54:
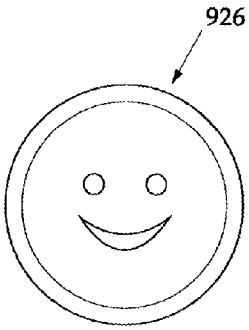

FIGS. 51A through 51C illustrate various alternative views of an example of the covering apparatus 901 as structured in accordance with various embodiments of the invention. FIG. 51A shows a partially cut away side view of the covering apparatus 901, and FIG. 51B depicts a front view of the covering apparatus 901. FIG. 51C includes a top view of the covering apparatus 901 of FIG. 51B. FIGS. 52 through 54 illustrate various alternative styles of covering apparatuses 922, 924, 926 that can be structured in accordance with certain embodiments of the invention. As shown, each cover apparatus 922, 924, 926 includes a unique number and configuration of supplemental dispensing orifices. It can be appreciated that the number, size, and configuration of supplemental dispensing orifices can be selected in response to factors such as material viscosity, fluid material type, desired fluid flow rate, desired dosage to be dispensed, and/or many other factors.

Figure 55:
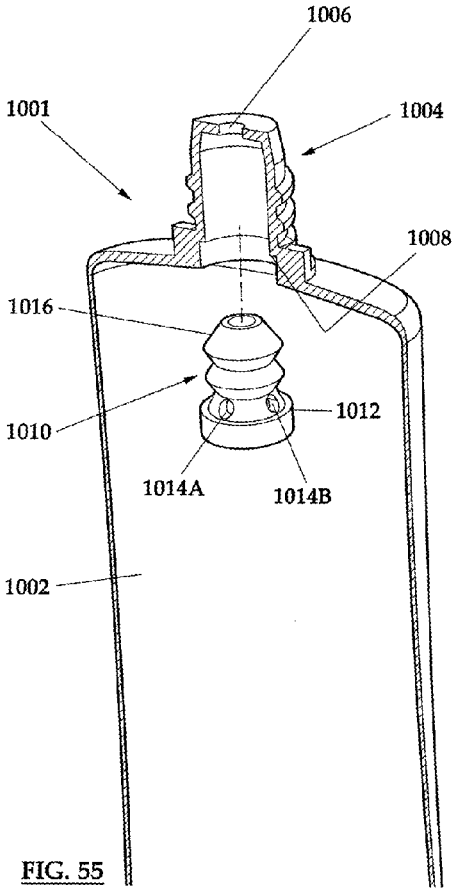
FIGS. 55 and 56 illustrate an example of an apparatus structured for dispensing fluid in accordance with various embodiments of the invention.
Figure 56:
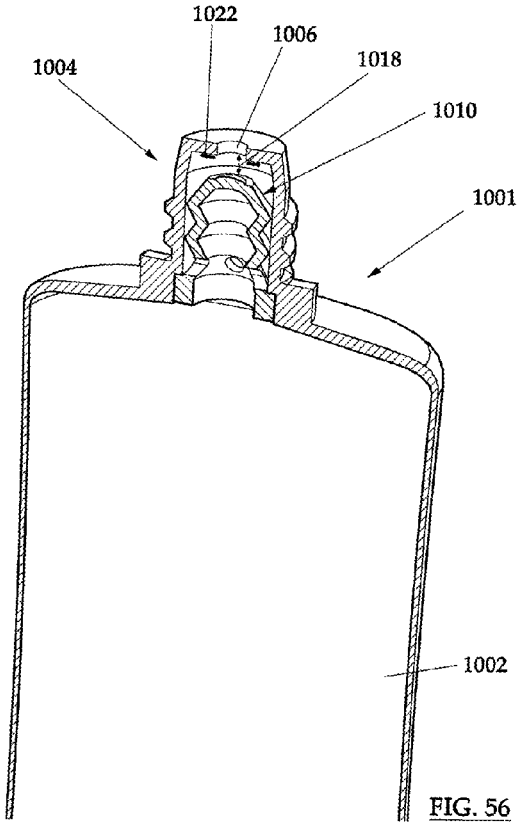

FIGS. 55 and 56 illustrate an example of an apparatus 1001 structured for dispensing fluid. As shown, the apparatus 1001 comprises a fluid repository 1002 in fluid communication with a nozzle 1004. The nozzle 1004 may include one or more dispensing orifices 1006 formed therein for communicating fluid from the interior of the fluid repository 1002 to an external location. In various embodiments, one or more retaining ridges 1008 may be positioned or formed on an interior surface of the nozzle 1004 for supporting or positioning various structures within the nozzle 1004. In various embodiments, a plug 1010 may be positioned and/or supported on at least a portion of the retaining ridge 1008 of the nozzle 1004. In operation, the plug 1010 may be positioned within at least a portion of the interior of the nozzle 1004.

In various embodiments, the plug 1010 may include a base portion 1012 having at least one fluid flow opening 1014 (such as openings 1014A, 1014B) formed therein. Also, the plug 1010 may include a bellows portion 1016 structured for expanding to an elongated state upon application of a threshold fluid pressure. In the elongated state, the plug 1010 can create a pathway for communicating fluid from the fluid repository 1002 through the fluid flow opening 1014 to the dispensing orifice 1006 upon application of the threshold fluid pressure. Also, the bellows portion 1016 may be configured for contracting to a compressed state in which the bellows portion 1016 contacts an interior surface of the nozzle 1004 to create a substantial fluid communication seal between the fluid repository 1002 and the dispensing orifice 1006. In the compressed state, it can be seen that substantially no fluid is permitted to flow from the fluid repository 1002 to the dispensing orifice 1006.

In various embodiments, at least a portion of the plug 1010 comprises a pathway for communicating fluid from the fluid repository 1002 to the dispensing orifice 1006 upon application of a threshold fluid pressure. The threshold fluid pressure may be provided by manual pressure applied to the fluid repository 1002, for example, or may be provided by another type of internal or external force. As illustrated, the retaining ridge 1008 may extend around the entire circumference of the interior of the nozzle 1004 to provide support and/or proper placement of the plug 1010. In certain embodiments, the retaining ridge 1008 may comprise one or more segments that extend at least partially around the circumference of the interior of the nozzle 1004 to provide support to the plug 1010. The retaining ridge 1008 may be structured to receive a correspondingly mating portion or segment of the plug 1010 when positioned for operation within the nozzle 1004. The plug 1010 may be positioned in place within the nozzle 1004 by use of a friction fit, a suitable adhesive, or another device or method known to those skilled in the art.

It can be seen that the retaining ridge 1008 may be structured for supporting the bellows portion 1016 of the plug 1010 at a predetermined gap distance 1018 from the dispensing orifice 1006 in the elongated state of the bellows portion 1016. In various embodiments, the predetermined gap distance 1018 may be selected for optimum performance in response to multiple variables such as fluid viscosity, size of the dispensing orifice 1006, and/or type of fluid being dispensed, among many other factors. It can be appreciated that the gap distance 1018 may be zero or substantially zero in certain embodiments, or may otherwise be a distance selected for optimizing desired performance characteristics based on fluid viscosity, for example, or other performance criteria.

In certain embodiments, a ring 1022 may be positioned between the bellows portion 1016 of the plug 1010 and the dispensing orifice 1006. For example, the ring 1022 may be structured as a crenellated ring configured to maintain a predetermined gap distance between the bellows portion 1016 and the dispensing orifice 1006 in the elongated state of the bellows portion 1016.

Figure 57C:
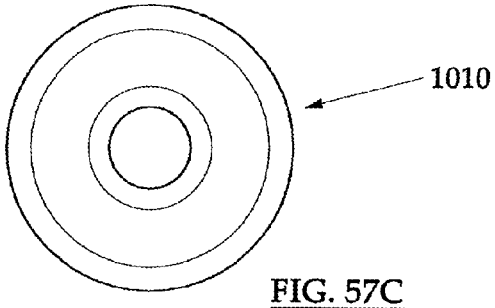
FIGS. 57A through 57D illustrate alternative views of an example of a plug structured in accordance with various embodiments of the invention.
Figure 57A:
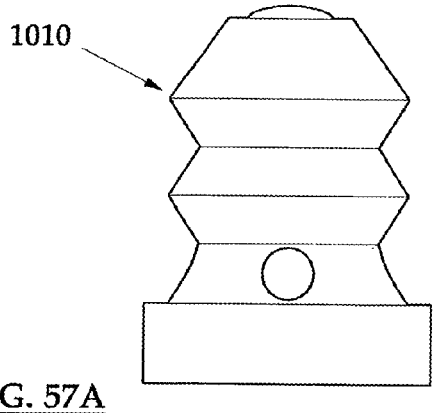
Figure 57B:
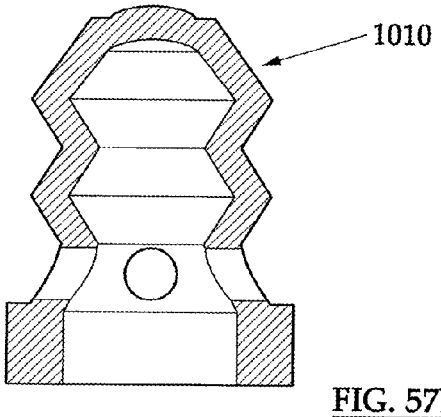
Figure 57D:
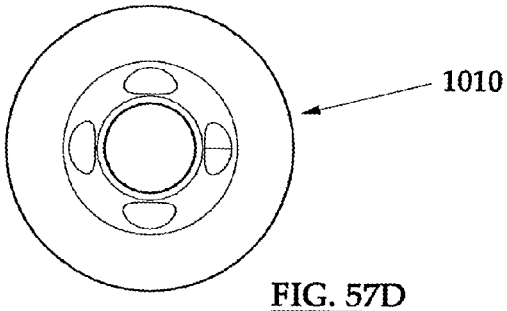

FIGS. 57A through 57D illustrate various alternative views of an example of the plug 1010 as structured in accordance with various embodiments of the invention. FIG. 57A shows a front view of the plug 1010. FIG. 57B shows a partially cut away side view of the plug 1010 shown in FIG. 57A. FIG. 57C shows a top view of the plug 1010 of FIG. 57A, and FIG. 57D depicts a bottom view of the plug 1010 included in FIG. 57A.

Figure 58:
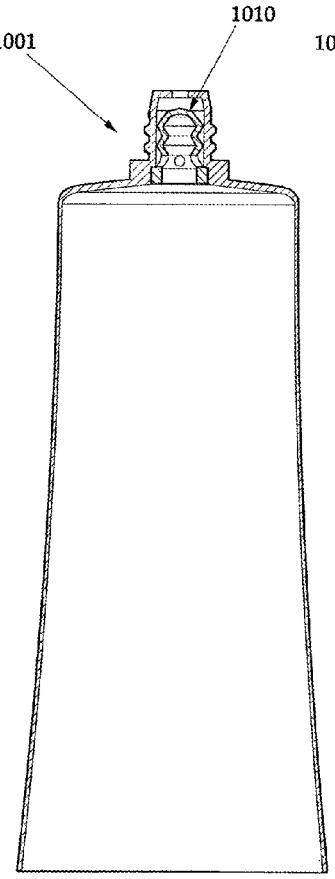
FIG. 58 illustrates a plug positioned for operation within a nozzle.
Figure 59:
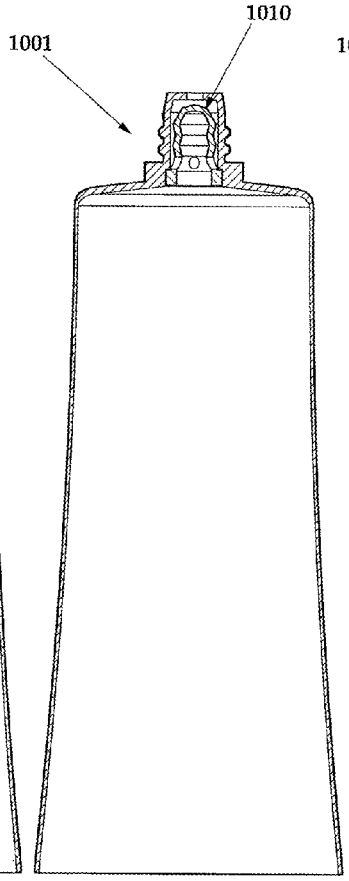
FIG. 59 illustrates the effect of applying a threshold fluid pressure to the interior of a plug.
Figure 60:
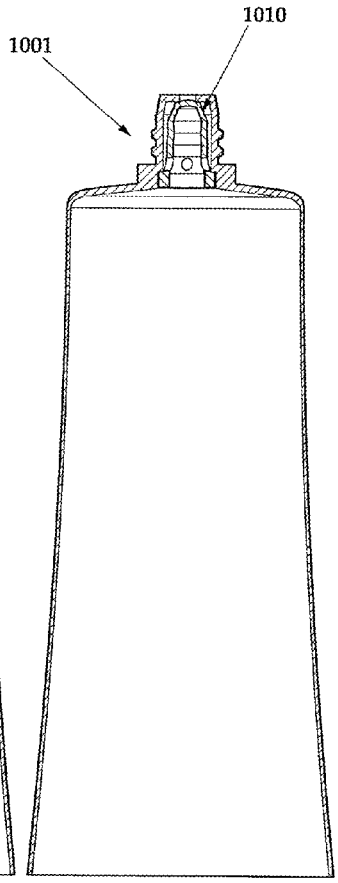
FIG. 60 illustrates a condition of a plug in which further pressure is exerted beyond a threshold fluid pressure.

FIG. 58 illustrates the plug 1010 positioned for operation within the nozzle 1004 of the apparatus 1001 in a pre-pressurized state or compressed condition. FIG. 59 illustrates the effect of applying a threshold fluid pressure to the interior of the plug 1010, causing the bellows portion of the plug to expand to the elongated state, and thereby creating a path for fluid flow from the fluid repository 1002, through the plug 1010, and toward the dispensing orifice 1006. FIG. 60 illustrates a condition of the plug 1010 in which further pressure is exerted beyond the threshold fluid pressure. As shown, the bellows portion may cover the dispensing orifice 1006 creating a substantial fluidic seal. This can be beneficial in the event that too much pressure is applied to the apparatus 1001, essentially creating a check valve wherein excessive fluid will not be dispensed from the fluid repository 1002.

Figure 61:
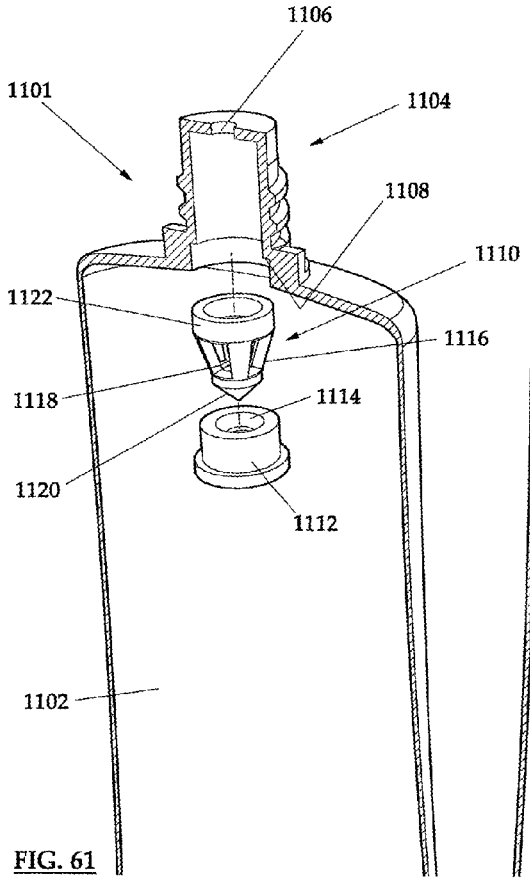
FIGS. 61 and 62 illustrate an example of an apparatus structured for dispensing fluid in accordance with various embodiments of the invention.
Figure 62:
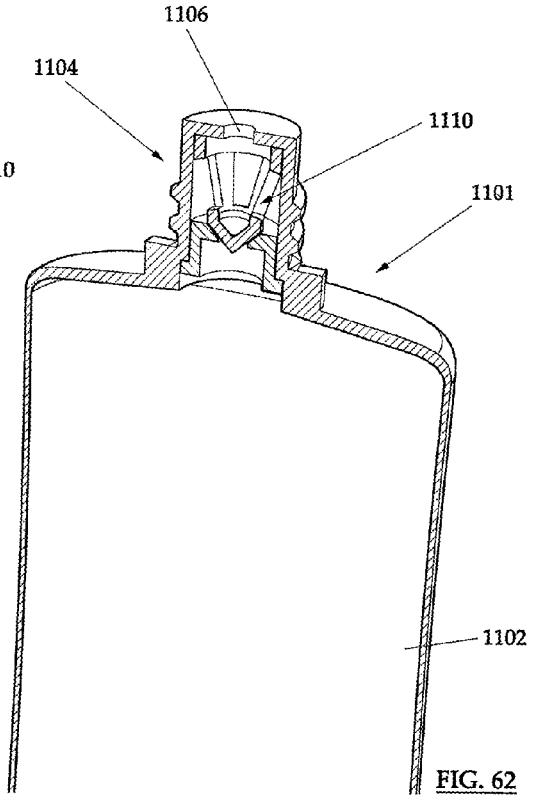

FIGS. 61 and 62 illustrate an example of an apparatus 1101 structured for dispensing fluid. As shown, the apparatus 1101 comprises a fluid repository 1102 in fluid communication with a nozzle 1104. The nozzle 1104 may include one or more dispensing orifices 1106 formed therein for communicating fluid from the interior of the fluid repository 1102 to an external location. In various embodiments, one or more retaining ridges 1108 may be positioned or formed on an interior surface of the nozzle 1104 for supporting or positioning various structures within the nozzle 1104. In various embodiments, a plug 1110 may be positioned and/or supported on at least a portion of the retaining ridge 1108 of the nozzle 1104. In operation, the plug 1110 may be positioned within at least a portion of the interior of the nozzle 1104.

In various embodiments, the plug 1110 may include a base 1112 having at least one fluid flow opening 1114 formed therein. In addition, the plug 1110 may include a valve 1116 having at least one fluid flow opening 1118 formed therein. In operation, the valve 1116 may be structured for expanding to an elongated state wherein a tip 1120 of the valve 1116 extends into the fluid flow opening 1114 of the base 1112 to create a substantial fluid communication seal between the fluid repository 1102 and the dispensing orifice 1106. It can be seen that the valve 1116 may further include a ring stand 1122 which contacts an interior surface of the nozzle 1104 near the dispensing orifice 1106 in the elongated state of the valve 1116.

Also, the valve 1116 may be structured for contracting to a compressed state upon application of a threshold fluid pressure wherein the tip 1120 of the valve 1116 dissociates from the fluid flow opening 1114 of the base 1112 to create a pathway for communicating fluid from the fluid repository 1002 through the fluid flow opening 1114 of the base 1112, through the fluid flow opening 1118 of the valve 1116, and further to the dispensing orifice 1106. In various embodiments, the fluid flow openings 1114, 1118 may be suitably dimensioned to accommodate fluids of different viscosity, material type, desired fluid flow rate, or desired dosage to be dispensed, among many other factors.

In various embodiments, the valve 1116 may be comprised of an elastomeric material or another type of flexible material capable of expanding and contracting as described above. The base 1112 of the plug 1110 may be comprised of a material that is comparatively more rigid than a material comprising the valve 1116 of the plug 1110.

In various embodiments, at least a portion of the plug 1110 comprises a pathway for communicating fluid from the fluid repository 1102 to the dispensing orifice 1106 upon application of a threshold fluid pressure. The threshold fluid pressure may be provided by manual pressure applied to the fluid repository 1102, for example, or may be provided by another type of internal or external force. As illustrated, the retaining ridge 1108 may extend around the entire circumference of the interior of the nozzle 1104 to provide support and/or proper placement of the plug 1110. In certain embodiments, the retaining ridge 1108 may comprise one or more segments that extend at least partially around the circumference of the interior of the nozzle 1104 to provide support to the plug 1110. The retaining ridge 1108 may be structured to receive a correspondingly mating portion or segment of the plug 1110 when positioned for operation within the nozzle 1104. The plug 1110 may be positioned in place within the nozzle 1104 by use of a friction fit, a suitable adhesive, or another device or method known to those skilled in the art.

Figure 63B:
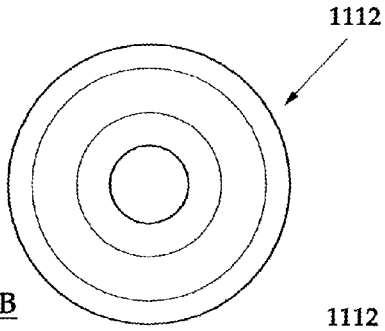
FIGS. 63A through 63C illustrate alternative views of an example of a base of a plug structured in accordance with various embodiments of the invention.
Figure 63A:
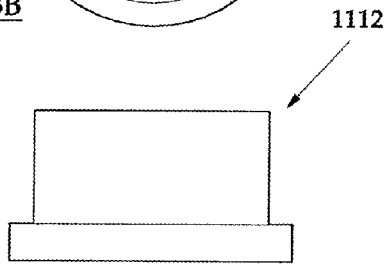
Figure 63C:
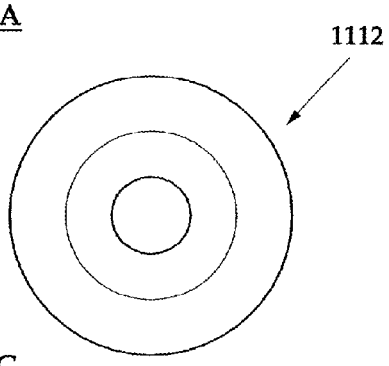

FIGS. 63A through 63C illustrate various alternative views of an example of the base 1112 of the plug 1110 as structured in accordance with various embodiments of the invention. FIG. 63A includes a front view of the base 1112. FIG. 63B shows a top view of the base 1112 shown in FIG. 63A, and FIG. 63C shows a bottom view of the base 1112 shown in FIG. 63A.

Figure 64B:
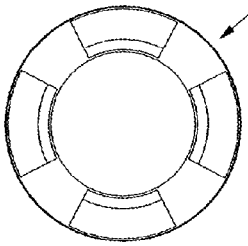
FIGS. 64A through 64C illustrate alternative views of an example of a valve of a plug structured in accordance with various embodiments of the invention.
Figure 64A:
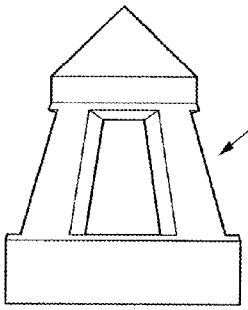
Figure 64C:
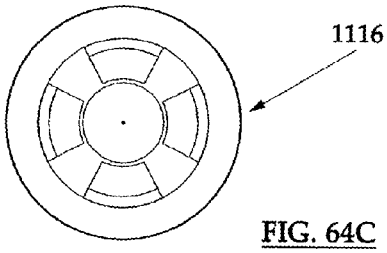

FIGS. 64A through 64C illustrate various alternative views of an example of the valve 1116 of the plug 1110 as structured in accordance with various embodiments of the invention. FIG. 64A includes a front view of the valve 1116. FIG. 64B shows a top view of the valve 1116 shown in FIG. 64A, and FIG. 64C shows a bottom view of the valve 1116 shown in FIG. 64A.

Figure 65:
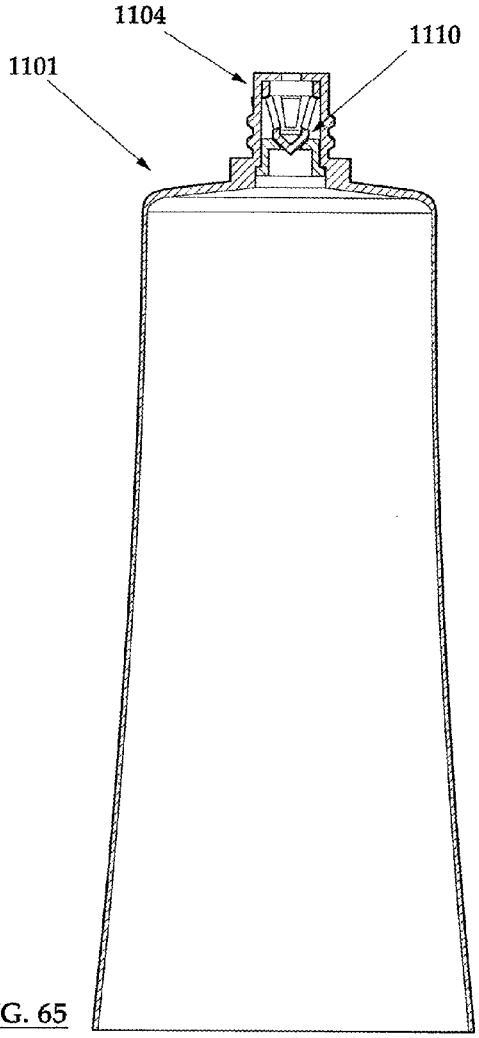
FIG. 65 illustrates a plug positioned for operation within a nozzle.
Figure 66:
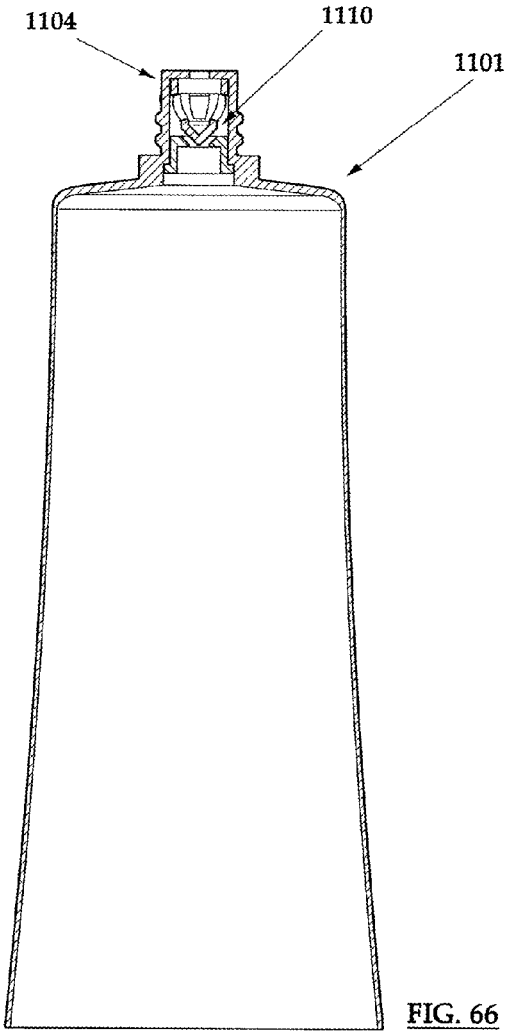
FIG. 66 illustrates the effect of applying a threshold fluid pressure to the interior of a plug.

FIG. 65 illustrates the plug 1110 positioned for operation within the nozzle 1104 of the apparatus 1101 in a pre-pressurized state or elongated condition. FIG. 66 illustrates the effect of applying a threshold fluid pressure to the interior of the plug 1110, causing the valve 1116 of the plug 1110 to compress, and also creating a path for fluid flow from the fluid repository 1102, through the plug 1110, and toward the dispensing orifice 1106.

Various of the structures, apparatuses, and other materials described herein may be comprised of a suitable material such as polypropylene or an elastomeric material, for example. It can be appreciated that materials that comprise the various strictures can be selected for their rigidity, flexibility, and/or suitability for use within a consumer product.

The examples presented herein are intended to illustrate potential and specific implementations of the present invention. It can be appreciated that the examples are intended primarily for purposes of illustration of the invention for those skilled in the art. No particular aspect or aspects of the examples are necessarily intended to limit the scope of the present invention.

Any element expressed herein as a means for performing a specified function is intended to encompass any way of performing that function including, for example, a combination of elements that performs that function. Furthermore the invention, as may be defined by such means-plus-function claims, resides in the fact that the functionalities provided by the various recited means are combined and brought together in a manner as defined by the appended claims. Therefore, any means that can provide such functionalities may be considered equivalents to the means shown herein.

It will be appreciated that, for convenience and clarity of disclosure, terms describing relative orientation or spatial positioning such as "proximal," "distal," "vertical," "horizontal," "up," "down," "top," "front," "back," "bottom," "upward," or "downward" may be used at times herein with respect to the drawings and text description in association with various embodiments of the invention. However, such terms are primarily used for illustrative purposes and are not necessarily intended to be limiting in nature.

It is to be understood that the figures and descriptions of the present invention have been simplified to illustrate elements that are relevant for a clear understanding of the present invention, while eliminating, for purposes of clarity, other elements. Those of ordinary skill in the art will recognize, however, that these and other elements may be desirable. However, because such elements are well known in the art, and because they do not facilitate a better understanding of the present invention, a discussion of such elements is not provided herein. It should be appreciated that the figures are presented for illustrative purposes and not as construction drawings. Omitted details and modifications or alternative embodiments are within the purview of persons of ordinary skill in the art. For example, there may be variations to these diagrams or the operations described herein without departing from the spirit of the invention.

It can be appreciated that, in certain aspects of the present invention, a single component may be replaced by multiple components, and multiple components may be replaced by a single component, to provide an element or structure or to perform a given function or functions. Except where such substitution would not be operative to practice certain embodiments of the present invention, such substitution is considered within the scope of the present invention.

While various embodiments of the invention have been described herein, it should be apparent, however, that various modifications, alterations and adaptations to those embodiments may occur to persons skilled in the art with the attainment of some or all of the advantages of the present invention. The disclosed embodiments are therefore intended to include all such modifications, alterations and adaptations without departing from the scope and spirit of the present invention as claimed herein.

What is claimed is:

1. An apparatus for dispensing fluid, the apparatus comprising:

a fluid repository in fluid communication with a nozzle, wherein the nozzle includes at least one dispensing orifice formed therein; and, a plug positioned within at least a portion of the interior of the nozzle, the plug comprising:

a base portion having at least one fluid flow opening formed therein, and a bellows portion structured for:

expanding to an elongated state upon application of a threshold fluid pressure to create a pathway for communicating fluid from the fluid repository through the fluid flow opening to the dispensing orifice upon application of a threshold fluid pressure, and contracting to a compressed state wherein the bellows portion contacts an interior surface of the nozzle to create a fluid communication seal between the fluid repository and the dispensing orifice.

2. The apparatus of claim 1, wherein at least a portion of the base portion of the plug is structured for correspondingly mating with at least a portion of the interior of the nozzle or the fluid repository for retaining the plug in an operative position.

3. The apparatus of claim 1, wherein the plug is structured to establish a predetermined gap distance between the bellows portion and the dispensing orifice in the elongated state of the bellows portion.

4. The apparatus of claim 3, wherein the predetermined gap distance is structured in response to a fluid viscosity.

5. The apparatus of claim 1, further comprising a plurality of fluid flow openings formed in the base portion of the plug.

6. The apparatus of claim 1, further comprising a ring positioned between the bellows portion of the plug and the dispensing orifice.

7. The apparatus of claim 6, wherein the ring comprises a crenellated ring structured to maintain a predetermined gap distance between the bellows portion and the dispensing orifice in the elongated state of the bellows portion.

8. The apparatus of claim 1, wherein the plug is structured to communicate fluid therethrough at a threshold fluid pressure not exceeding a pressure applied to the fluid repository.

9. The apparatus of claim 1, wherein the plug is structured to communicate fluid therethrough at a threshold fluid pressure independent of a pressure applied to the fluid repository.

10. The apparatus of claim 1, wherein at least one of the fluid flow openings is structured in response to a fluid viscosity.

11. A plug apparatus for facilitating fluid flow in a fluid dispensing apparatus comprising a fluid repository in fluid communication with a nozzle, wherein the nozzle includes at least one dispensing orifice formed therein, the plug apparatus comprising:

a base portion structured for placement in at least a portion of the interior of the nozzle of the fluid dispensing apparatus, the base portion having at least one fluid flow opening formed therein, and a bellows portion structured for:

expanding to an elongated state upon application of a threshold fluid pressure to create a pathway for communicating fluid from the fluid repository through the fluid flow opening to the dispensing orifice upon application of a threshold fluid pressure, and contracting to a compressed state wherein the bellows portion contacts an interior surface of the nozzle to create a fluid communication seal between the fluid repository and the dispensing orifice.

* * * * *